US011248858B2

(12) United States Patent
Ueda et al.

(10) Patent No.: US 11,248,858 B2
(45) Date of Patent: Feb. 15, 2022

(54) HEAT TRANSFER DEVICE AND FURNACE USING SAME

(71) Applicants: National University Corporation Tokyo University of Agriculture and Technology, Tokyo (JP); Shoden Kogyo Co., Ltd., Kanagawa (JP)

(72) Inventors: Yuki Ueda, Fuchu (JP); Kazuyuki Yoshioka, Yokohama (JP)

(73) Assignees: National University Corporation Tokyo University of Agriculture and Technology, Tokyo (JP); Shoden Kogyo Co., Ltd., Kanagawa (JP)

( * ) Notice: Subject to any disclaimer, the term of this patent is extended or adjusted under 35 U.S.C. 154(b) by 189 days.

(21) Appl. No.: 16/615,403

(22) PCT Filed: May 9, 2018

(86) PCT No.: PCT/JP2018/018011

§ 371 (c)(1),
(2) Date: Nov. 21, 2019

(87) PCT Pub. No.: WO2018/216472

PCT Pub. Date: Nov. 29, 2018

(65) Prior Publication Data

US 2020/0103185 A1 Apr. 2, 2020

(30) Foreign Application Priority Data

May 25, 2017 (JP) ..... JP2017-103794

(51) Int. Cl.
*F28F 13/18* (2006.01)
*F28D 15/02* (2006.01)

(52) U.S. Cl.
CPC ..... *F28F 13/182* (2013.01); *F28D 15/0266* (2013.01)

(58) Field of Classification Search
CPC .... F28F 13/182; F28D 15/0266; F28D 17/00; F28D 19/00; F28D 21/0001; F28D 20/00; Y02E 60/14

(Continued)

(56) References Cited

U.S. PATENT DOCUMENTS 3,080,706 A * 3/1963 Flynn, Jr. ..... F02G 1/044 60/523
3,181,601 A * 5/1965 Brandt ..... F28D 17/02 165/4

(Continued)

FOREIGN PATENT DOCUMENTS

CN 105114268 A 12/2015
EP 0488942 A2 6/1992

(Continued)

OTHER PUBLICATIONS

International Search Report issued in corresponding International Patent Application No. PCT/JP2018/018011 dated Jul. 17, 2018.

(Continued)

*Primary Examiner* — Justin M Jonaitis
(74) *Attorney, Agent, or Firm* — Morgan, Lewis & Bockius LLP

(57) ABSTRACT

Provided is a heat transfer device comprising: a housing; a regenerator; a first heat exchanger; and a second heat exchanger.

13 Claims, 32 Drawing Sheets

(58) Field of Classification Search
USPC ..... 165/133, 4, 10, 909, DIG. 9
See application file for complete search history.

(56) References Cited

U.S. PATENT DOCUMENTS 3,213,640 A * 10/1965 Dubinsky ..... F25B 9/004 62/402
3,274,751 A * 9/1966 Skarstrom ..... F24F 3/16 95/122
3,678,992 A * 7/1972 Daniels ..... F28D 17/02 165/10
4,259,844 A * 4/1981 Sarcia ..... F25B 9/14 165/10
6,968,688 B2 * 11/2005 Gimsa ..... F02G 1/043 417/379

FOREIGN PATENT DOCUMENTS

| | | | |
|---|---|---|---|
| JP | 2005-201623 | A | 7/2005 |
| JP | 2009-074722 | A | 4/2009 |
| JP | 2014-047979 | A | 3/2014 |
| WO | 03/004946 | A1 | 1/2003 |

OTHER PUBLICATIONS

Nakamura et al., "Design and Construction of a Standing-Wave Thermoacoustic Engine with Heat Sources Having a Given Temperature Ratio," Journal of Thermal Science and Technology, 6 (3): 416-423 (2011).
Office Action issued in corresponding Japanese Patent Application No. 2019-519552 dated Aug. 18, 2020.
Office Action issued in corresponding German Patent Application No. 112018002662.0 dated Jan. 13, 2021.

* cited by examiner

HEAT TRANSFER DEVICE AND FURNACE USING SAME

TECHNICAL FIELD

The present disclosure relates to a heat transfer device and a furnace using the same.

BACKGROUND ART

Conventionally, various heat transfer devices are used. Types of heat transfer devices include (A) heat transfer devices that use a phase change and (B) heat transfer devices that utilize convective heat transfer (forced cooling) resulting from forcibly flowing a heat medium.

Representative examples of heat transfer devices of type (A) include heat pipes. A heat pipe is a device that has a working fluid inside, and the working fluid takes heat from a heat source by changing (boiling) from a liquid phase to a gas phase in the high-temperature portion of the heat pipe and releases heat to a heat bath by changing (condensing) from a gas phase to a liquid phase in the low-temperature portion of the heat pipe (e.g., see JP-A No. 2014-47979). Heat pipes have the advantage that they are driven without requiring a power supply (without input work).

Heat transfer devices of type (B) usually use a liquid as the heat medium, and cooling with water is particularly effective for cooling below boiling point.

SUMMARY

Technical Problem

In this connection, heat pipes, which are a representative example of heat transfer devices of type (A), have the problem that if the temperature difference between the heat source (the high-temperature portion) and the low-temperature portion is small, the heat pipe is not driven, and if the temperature difference is large, the heat pipe dries out.

Furthermore, in a case where the heat source is at a high temperature (e.g., 500° C.), it becomes difficult to select a working fluid that can stay a liquid under the high temperature. This condition is cleared by selecting a metal (e.g., sodium) for the working fluid, but owing to its physical properties there is the danger of explosion.

Moreover, in a case where the temperature of the heat source gradually falls because of heat transfer, it is difficult to utilize a heat pipe. That is, this is because it is considered that the heat transfer efficiency of a heat pipe set to transfer heat efficiently at an initial temperature (e.g., 500° C.) falls as the temperature falls, because the temperature that produces the phase change in the working fluid is fixed.

In heat transfer devices of type (B), if a liquid is selected as the heat medium, there is the concern that the heat medium will explode in the same way as in a heat pipe in a case where the heat source is at a high temperature (e.g., 500° C.).

If a gas is selected as the heat medium, the gas can be applied even when the heat source is at a high temperature. However, it becomes necessary to cause the heat medium (inert gas) to circulate inside the sealed space because there is no driving force resulting from a phase change. Furthermore, the heat medium reaches a high temperature, so an expensive pump that is resistant to pressure and resistant to heat (resistant to high temperatures) becomes necessary. Consequently, if a gas is selected as the heat medium, there are the problems that the introduction cost becomes high and running costs resulting from driving the pump and maintenance costs for the pump and so forth are incurred.

The present disclosure provides a heat transfer device that is very safe and can be introduced and used at a low cost and a furnace that uses the same.

Solution to Problem

A first aspect of the disclosure is a heat transfer device comprising (i) a housing that is disposed straddling a high-temperature heat source and a low-temperature heat bath having lower temperature than the high-temperature heat source, that has a closed space within which a gas is sealed, and that has a conduit formed inside, both end portions of the conduit being closed off, (ii) a regenerator that is disposed in the conduit, and at which are formed pores that communicate both end portions of the regenerator with each other, and which is insulated from the outside of the housing, (iii) a first heat exchanger that is provided adjacent to the end portion of the regenerator on the high-temperature heat source side in the conduit, and that allows heat of the high-temperature heat source to move toward the regenerator, and (iv) a second heat exchanger that is provided adjacent to the end portion of the regenerator on the low-temperature heat bath side in the conduit, and that allows heat of the regenerator to move toward the low-temperature heat bath, wherein the center of the regenerator along the extending direction of the conduit is positioned on the conduit in a position that is from 12.5% to 25% of the conduit length from the end portion of the conduit on the high-temperature heat source side.

According to the first aspect, inside the housing that is disposed straddling the high-temperature heat source side and the low-temperature heat bath and comprises the closed space, the gas is sealed and the conduit with both end portions closed off is formed. Disposed in the conduit are the regenerator, which is insulated from the outside of the housing and in which are formed the pores that communicate both end portions of the regenerator to each other, the first heat exchanger, which is adjacent to the end portion of the regenerator on the high-temperature heat source side (hereinafter called a "first end portion") and allows the heat of the high-temperature heat source to move to the regenerator, and the second heat exchanger, which is adjacent to the end portion of the regenerator on the low-temperature heat bath side (hereinafter called a "second end portion") and allows the heat of the regenerator to move to the low-temperature heat bath.

Consequently, when a temperature gradient is produced in the regenerator from the first end portion to the second end portion and the temperature ratio between the first end portion and the second end portion exceeds a threshold, the gas in the pores of the regenerator undergoes thermoacoustic self-excited oscillations. As a result, a standing wave is generated in the conduit.

Here, the center of the regenerator in the direction in which the conduit extends is positioned on the conduit in a position that is 12.5% to 25% of the conduit length from the end portion of the conduit on the high-temperature heat source side, so the regenerator is disposed in such a way that the pressure amplitude of the standing wave (in a ½-wavelength mode) of the thermoacoustic self-excited wave monotonically decreases from the first end portion to the second end portion.

As a result, it becomes possible to transfer heat from the first end portion side to the second end portion side in the regenerator by heat exchange between the gas in the pores of the regenerator and the porous wall portions. In particular, because the regenerator is disposed in the above-described position on the conduit, the product of the pressure amplitude and the velocity amplitude of the standing wave increases. Because of this, the heat transfer efficiency resulting from the regenerator is enhanced even more.

That is, the heat of the high-temperature heat source can be efficiently removed via the first heat exchanger, the regenerator, and the second heat exchanger to the low-temperature heat bath.

It will be noted that this heat transfer device does not need a drive source, so running costs and maintenance costs are unnecessary, it can be introduced and used at a low cost, and it does not use a phase change from gas to liquid, so it is very safe compared to heat transfer devices that use a phase change.

A second aspect of the disclosure is a heat transfer device wherein, in the first aspect, the conduit includes (i) an inner tube, a part of which communicates the high-temperature heat source side with the low-temperature heat bath side in the housing and (ii) an outer tube that is formed on the outer side of the inner tube, and that communicates with the inner tube on the low-temperature heat bath side, an end portion on the high-temperature heat source side of the outer tube being closed off, and the first heat exchanger, the second heat exchanger, and the regenerator are disposed in the outer tube.

According to the second aspect, part of the conduit has a double-tube structure comprising the inner tube and the outer tube that is formed on the outer side of the inner tube, and the end portion of the outer tube on the high-temperature heat source side is closed off. Furthermore, the regenerator, the first heat exchanger, and the second heat exchanger are disposed in the outer tube. It will be noted that the outer tube and the inner tube are communicated with each other at the end portion on the low-temperature heat bath side. That is, inside the housing is formed a conduit that extends from the end portion (the closed-off portion) of the outer tube on the high-temperature heat source side via the outer tube, the end portion of the housing on the low-temperature heat bath side, and the inner tube to the end portion of the housing on the high-temperature heat source side.

Consequently, when a temperature gradient is produced from the first end portion to the second end portion in the regenerator disposed in the outer tube and the temperature ratio between the first end portion and the second end portion exceeds the threshold, the gas in the pores of the regenerator undergoes thermoacoustic self-excited oscillations. As a result, a standing wave is generated in the conduit.

Here, the center of the regenerator in the direction in which the conduit extends is positioned on the conduit in a position that is 12.5% to 25% of the conduit length from the end portion on the high-temperature heat source side (the closed-off portion of the outer tube), so the regenerator is disposed in such a way that the pressure amplitude of the standing wave (in a ½-wavelength mode) of the thermoacoustic self-excited wave monotonically decreases from the first end portion to the second end portion.

As a result, it becomes possible to transfer heat from the first end portion side to the second end portion side in the regenerator by heat exchange between the gas in the pores of the regenerator and the porous wall portions. In particular, by disposing the regenerator in the above-described position on the conduit, the product of the pressure amplitude and the velocity amplitude of the standing wave increases. Because of this, the heat transfer efficiency is maximized.

That is, the heat of the high-temperature heat source can be efficiently removed via the first heat exchanger, the regenerator, and the second heat exchanger to the low-temperature heat bath.

It will be noted that this heat transfer device does not need a drive source, so running costs and maintenance costs are unnecessary, it can be introduced and used at a low cost, and it does not use a phase change from gas to liquid, so it is very safe compared to heat transfer devices that use a phase change.

At this time, a conduit that extends from the end portion of the outer tube on the high-temperature heat source side via the end portion of the housing on the low-temperature heat bath side and the inner tube to the end portion of the housing on the high-temperature heat source side is configured, so the volume of the housing that projects on the low-temperature heat bath side can be reduced. That is, when this heat transfer device is utilized as a heat rejecting means, the volume of the portion that projects outside the high-temperature heat source, such as a furnace for example, can be kept down (downsized).

A third aspect of the disclosure is the first or second aspect, wherein the heat transfer device has a regulating unit that is disposed in the end portion of the housing on the low-temperature heat bath side so as to be movable forward and backward inside the housing and that transforms the waveform of a standing wave generated in the conduit by a thermoacoustic self-excited wave, by moving forward inside the housing.

According to the third aspect, the waveform (wavelength and amplitude) of the standing wave in a ½-wavelength mode produced in the conduit by the thermoacoustic self-excited wave is changed by the regulating means that moves forward and backward with respect to the inside of the housing. For example, when the waveform of the standing wave is changed by inserting the regulating means so that the pressure amplitude (the product of the pressure amplitude and the velocity amplitude) of the standing wave at the position of the regenerator is changed, the heat transfer amount can be regulated. Alternatively, when the pressure amplitude no longer monotonically decreases from the first end portion to the second end portion of the regenerator, the generation of the thermoacoustic self-excited wave in the regenerator can be arrested so that the heat transfer of the heat transfer device can be stopped.

A fourth aspect of the disclosure is a furnace comprising (i) a furnace wall configured from insulation, (ii) a heater that is disposed inside of the furnace circumscribed by the furnace wall, and that heats the inside of the furnace, and (iii) the heat transfer device according to the first to the third aspects, at which the regenerator is disposed at the furnace wall, the first heat exchanger is disposed inside the furnace, and the second heat exchanger is disposed outside the furnace, at least when cooling the furnace.

According to the fourth aspect, a difference arises between the temperature inside the furnace, which has been raised by driving the heater, and the temperature outside the furnace. Here, at least when cooling the furnace, the heat transfer device applied to the furnace has the regenerator disposed in the furnace wall, the first heat exchanger disposed inside the furnace which is at a high temperature, and the second heat exchanger disposed outside the furnace which is at a low temperature. Consequently, when the temperature ratio between both end portions (the first end portion (the end portion on the first heat exchanger side) and the second end portion (the end portion on the second heat exchanger side)) of the regenerator 18 exceeds the threshold because of the temperature difference between the inside of the furnace and the outside of the furnace, thermoacoustic self-excited oscillations are produced in the regenerator. The thermoacoustic self-excited oscillations produce a standing wave on the conduit of the heat transfer device. Furthermore, because the center of the regenerator is positioned on the conduit in a position that is 12.5% to 20% of the conduit length from the end portion on the high-temperature heat source (inside the furnace) side, the pressure amplitude monotonically decreases from the first heat exchanger to the second heat exchanger. As a result, heat efficiently moves from the first heat exchanger to the second heat exchanger. That is, the heat inside the furnace is efficiently rejected via the heat transfer device to the outside of the furnace.

Furthermore, the heat transfer device disposed as a means for cooling the furnace does not need a drive source, so running costs and maintenance costs are unnecessary, it can be introduced to and used in the furnace at a low cost, and it does not use a phase change from gas to liquid, so it is very safe compared to heat transfer devices that use a phase change.

A fifth aspect of the disclosure is a furnace wherein, in the fourth aspect, the furnace further comprises a reflector that reflects radiation inside the furnace so as to be incident on the heat transfer device disposed inside the furnace.

According to the fifth aspect, when cooling the furnace, the radiation inside the furnace is reflected by the reflector and made incident on the heat transfer device, whereby the first heat exchanger of the heat transfer device is efficiently heated. That is, the heat inside the furnace is rejected even more efficiently to the outside of the furnace by the heat transfer device.

A sixth aspect of the disclosure is a furnace wherein, in the fifth aspect, the furnace further comprises a shaft body that supports the reflector within the furnace, and that extends from the inside of the furnace to the outside of the furnace.

According to the sixth aspect, the shaft body that runs through the furnace wall supports the reflector, so the reflector can be installed in an arbitrary position inside the furnace.

A seventh aspect of the disclosure is a furnace wherein, in the sixth aspect, the reflector is configured to be rotatable integrally with the shaft body about the axial direction of the shaft body.

According to the seventh aspect, the reflector is configured to be rotatable by the shaft body. Consequently, for example, when heating the furnace, the reflector is pointed in the direction in which reflection of the radiation from the heater is inhibited from being made incident on the heat transfer device. Because of this, when raising the temperature in the furnace, a situation where the radiation from the heater is made incident on the heat transfer device via the reflector and the heat inside the furnace is rejected to the outside of the furnace by thermal conduction through the heat transfer device that extends from the inside of the furnace to the outside of the furnace can be inhibited. That is, heating (raising the temperature) of the inside of the furnace can be efficiently performed.

Alternatively, when heating the furnace, for example, the reflector is pointed so as to reflect the radiation from the heater and make it incident on a work that is a heating target. Because of this, the radiation from the heater is efficiently made incident on the work, and the efficiency with which the work is heated is improved.

When cooling the furnace, the reflector is pointed in the direction in which it reflects the radiation inside the furnace and makes it incident on the heat transfer device, whereby the radiation inside the furnace can be concentrated and made incident on the heat transfer device. That is, the heat inside the furnace can be efficiently moved to the heat transfer device via the radiation.

In particular, by rotating the reflector about the axis of the shaft body when cooling the furnace, the heat can be moved to the heat transfer device by the radiation from a wide range inside the furnace. That is, the inside of the furnace can be evenly cooled.

In this way, when heating the furnace, the heating efficiency can be improved by inhibiting rejection of the heat to the outside of the furnace via the heat transfer device, and when cooling the furnace, the furnace can be efficiently cooled by using the standing wave of the thermoacoustic self-excited oscillations in the heat transfer device.

An eighth aspect of the disclosure is a furnace wherein, in the sixth or seventh aspect, a hole portion that extends in the axial direction of the shaft body is formed at the shaft body, the heat transfer device is disposed inside the hole portion, and, at least when cooling the furnace, the end portion of the heat transfer device, on the side at which the first heat exchanger is disposed, is exposed to a reflective surface side of the reflector.

As described above, in a case where the end portion of the heat transfer device disposed in the hole portion of the shaft body is exposed to the reflective surface side of the reflector, it becomes easier for the radiation inside the furnace to be reflected by the reflective surface and made incident on the end portion of the heat transfer device. In other words, it becomes possible to concentrate the radiation inside the furnace and make it incident on the end portion of the heat transfer device. As a result, the first heat exchanger side of the heat transfer device is heated, and the movement of the heat from the inside of the furnace to the first heat exchanger becomes efficient. As a result, the furnace can be efficiently cooled.

A ninth aspect of the disclosure is a furnace where, in the eighth aspect, part of the end portion of the heat transfer device, on the side at which the first heat exchanger is disposed, is positioned in a focus of the reflective surface of the reflector at least when cooling the furnace.

According to the ninth aspect, part of the heat transfer device is disposed in the position of the focus of the reflective surface of the reflector. Consequently, when cooling the furnace, the radiation inside the furnace is reflected by the reflector and made incident on the portion of the heat transfer device disposed in the position of the focus of the reflective surface of the reflector. That is, the reflection of the radiation inside the furnace is concentrated even more and made incident on the end portion of the heat transfer device on the first heat exchanger side. As a result, the heat inside the furnace moves even more efficiently to the heat transfer device and is rejected to the outside of the furnace.

A tenth aspect of the disclosure is a furnace wherein, in the eighth or ninth aspect, the reflector is configured to be movable forward and backward with respect to the furnace wall along the axial direction integrally with the shaft body.

According to the tenth aspect, when heating the furnace, the shaft body is moved forward inside the furnace, that is, in the direction in which the reflector is moved away from the furnace wall, whereby the first heat exchanger of the heat transfer device is accommodated inside (the hole portion of) the shaft body. Because of this, an increase in the temperature of the first heat exchanger of the heat transfer device positioned inside the furnace is inhibited, and the temperature ratio between both end portions of the regenerator is kept at or below the threshold. As a result, thermoacoustic self-excited oscillations are prevented from being produced in the regenerator of the heat transfer device, and heat rejection by the thermoacoustic self-excited oscillations in the heat transfer device is prevented. As a result, heat rejection when heating the furnace is inhibited, and the efficiency with which the furnace is heated is improved.

When cooling the furnace, the shaft body is withdrawn (displaced) outside the furnace, that is, in the direction in which the reflector is moved toward the furnace wall, whereby the end portion of the housing of the heat transfer device on the first heat exchanger side is exposed to the reflective surface side of the reflector from the end portion of the shaft body. As a result, the radiation inside the furnace is reflected by the (reflective surface of the) reflector and made incident on the end portion of the housing of the heat transfer device on the first heat exchanger side. That is, the heat inside the furnace is even more efficiently moved to the heat transfer device and is efficiently rejected to the outside of the furnace by the thermoacoustic self-excited oscillations.

According to an eleventh aspect of the disclosure, in the fourth to tenth aspects, the heat transfer device is configured to be movable forward and backward with respect to the furnace wall along the axial direction of the heat transfer device.

According to the eleventh aspect, when heating the furnace, the heat transfer device is moved outside the furnace so that the heat transfer device at least up to the first heat exchanger is disposed (accommodated) in the furnace wall. Because of this, the first heat exchanger of the heat transfer device is inhibited from being directly heated by the radiation inside the furnace when heating the furnace. As a result, the temperature ratio between both end portions of the regenerator of the heat transfer device is kept below the threshold, and thermoacoustic self-excited oscillations are prevented from being produced in the regenerator. As a result, the heat inside the furnace is inhibited from moving to the outside of the furnace via the heat transfer device. That is, the furnace can be efficiently heated.

When cooling the furnace, the heat transfer device is moved inside the furnace so that the portion of the heat transfer device from the first heat exchanger to the end portion side is exposed to the reflective surface side of the reflector. As a result, the radiation inside the furnace is reflected by the reflector and efficiently heats the end portion side of the heat transfer device exposed to the reflective surface side. Consequently, the first heat exchanger of the heat transfer device is efficiently heated, and the temperature ratio between both end portions of the regenerator exceeds the threshold, whereby the heat inside the furnace is efficiently rejected to the outside of the furnace.

A twelfth aspect of the disclosure is a furnace wherein, in the fourth to eleventh aspects, the plate thickness of the housing, from the position at which the radiation inside the furnace is incident to the position at which the first heat exchanger is disposed, is locally thicker than the plate thickness of the other portion of the housing.

According to the twelfth aspect, when cooling the furnace, the radiation inside the furnace is reflected by the reflector and made incident on the portion of the housing of the heat transfer device from the first heat exchanger to the end portion side. The housing of the heat transfer device is heated by the incidence of the radiation. The plate thickness of the housing of the heat transfer device from the position where the radiation inside the furnace is made incident to the position where the first heat exchanger is disposed is locally thick, so the thermal conduction amount in the heat transfer device is increased, and the heat that has moved to the heat transfer device can be efficiently moved to the first heat exchanger by the radiation. That is, the heat inside the furnace can be efficiently rejected to the outside of the furnace.

According to a thirteenth aspect of the disclosure is a furnace wherein, in the fourth to twelfth aspects, the portion of the housing on the outer peripheral side of the first heat exchanger is formed by a radiation-transmitting member.

According to the thirteenth aspect, when cooling the furnace, the radiation inside the furnace is made incident on the housing of the heat transfer device directly or after being reflected by the reflector. At this time, the radiation made incident at the position of the housing where the first heat exchanger is disposed is transmitted through the portion of the housing formed by the radiation-transmitting member and made incident on the first heat exchanger. That is, because the radiation inside the furnace is made incident on the first heat exchanger directly or after being reflected by the reflector, the heat inside the furnace moves to the first heat exchanger without involving thermal conduction in the heat transfer device. As a result, the heat inside the furnace can be rejected to the outside of the furnace even more efficiently.

DESCRIPTION OF EMBODIMENTS

Figure 1:
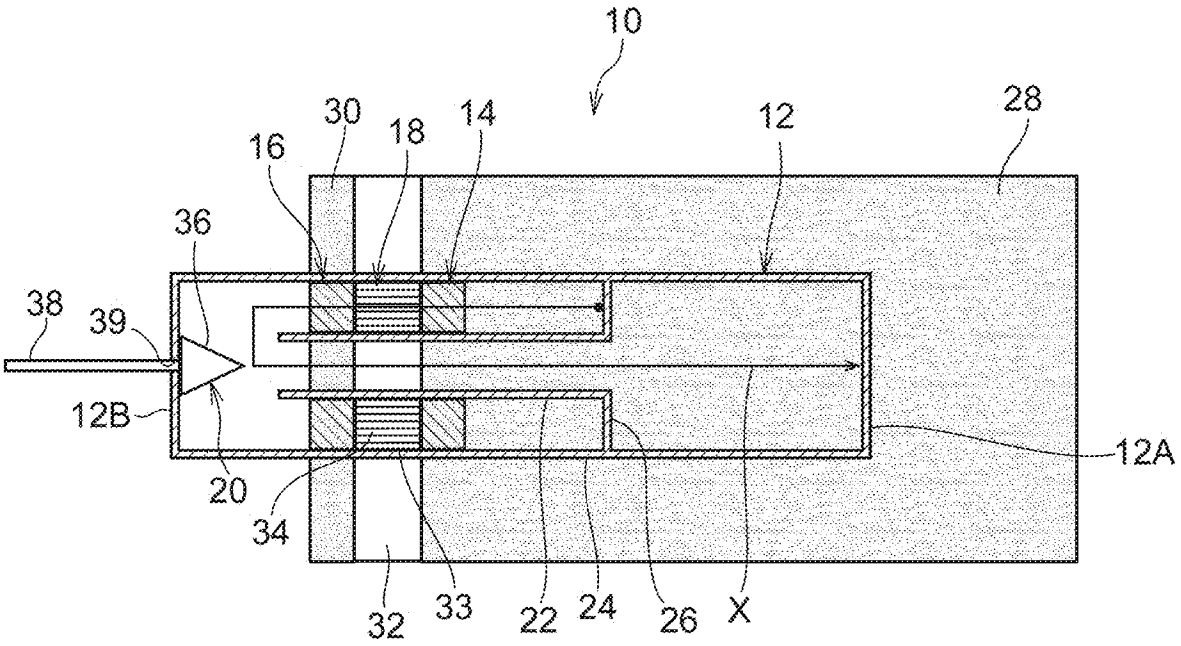
FIG. 1 is a general configuration diagram of a heat transfer device pertaining to a first embodiment.

Embodiments of the disclosure will be described in detail below with reference to the drawings. First, a heat transfer device pertaining to a first embodiment will be described, and an example where the heat transfer device is applied to a furnace will be described. Next, a heat transfer device pertaining to a second embodiment will be described, and an example where the heat transfer device is applied to a furnace will be described. Moreover, furnaces to which the heat transfer device of the first embodiment has been applied will be described as third to fifth embodiments.

First Embodiment (Device Configuration)

First, a heat transfer device 10 pertaining to the disclosure will be described with reference to FIG. 1. The heat transfer device 10 has a tubular body 12 that is a housing in the shape of a hollow cylinder, a first heat exchanger 14 and a second heat exchanger 16 that are disposed inside the tubular body 12, a regenerator 18 that is disposed between the first heat exchanger 14 and the second heat exchanger 16 inside the tubular body 12, and a regulating valve 20 that is attached so as to be movable forward and backward with respect to the inside of the tubular body 12.

(Tubular Body 12)

The tubular body 12 has the shape of a hollow cylinder, and the inside thereof is configured to be a closed space. The inside of the tubular body 12 is filled with a gas, such as nitrogen gas for example.

The tubular body 12 extends from a first end portion 12A at one end in its axial direction to a second end portion 12B at the other end, and an inner tube 22 that is coaxial with the tubular body 12 and is smaller in diameter than the tubular body 12 is formed in part of the axial direction. Both end portions of the inner tube 22 are open, and the inner tube 22 communicates the first end portion 12A side to the second end portion 12B side of the tubular body 12.

Furthermore, the portion circumscribed by the inner tube 22 and the part of the tubular body 12 positioned on the radial direction outer side of the inner tube 22 will for the sake of convenience be called an outer tube 24.

The end portion of the outer tube 24 on the first end portion 12A side is closed off by a closed-off surface 26, and the end portion of the outer tube 24 on the second end portion 12B side is open to the second end portion 12B side of the tubular body 12. That is, the inner tube 22 and the outer tube 24 are communicated with each other on the second end portion 12B side of the tubular body 12. Consequently, inside the tubular body 12 is formed a conduit X which extends from the closed-off surface 26 of the outer tube 24 via the outer tube 24, the second end portion 12B side of the tubular body 12, and the inner tube 22 to the first end portion 12A of the tubular body 12 and both end portions of which are closed off. L0 denotes the length of the conduit X (conduit length) along the conduit X from the closed-off surface 26 to the first end portion 12A.

Furthermore, inside the outer tube 24, the first heat exchanger 14, the regenerator 18, and the second heat exchanger 16 are disposed sequentially from the first end portion 12A side to the second end portion 12B side.

The first end portion 12A side of the tubular body 12 is disposed inside a high-temperature heat source 28 up to the position of the first heat exchanger 14 in the axial direction. The second end portion 12B side of the tubular body 12 is disposed with the position of the second heat exchanger 16 in the axial direction inside a low-temperature heat bath 30 lower in temperature than the high-temperature heat source 28.

It will be noted that in the present embodiment "high-temperature heat source" means the external environment from which heat is supplied to the heat transfer device 10 and "low-temperature heat bath" means the external environment to which heat is rejected from the heat transfer device 10.

Moreover, an insulating member 32 is disposed around (the outer periphery of) the portion of the tubular body 12 where the regenerator 18 is disposed. Consequently, the regenerator 18 is insulated from the outside of the tubular body 12.

Furthermore, the regulating valve 20 described later is disposed in the second end portion 12B side of the tubular body 12.

(First Heat Exchanger 14)

As shown in FIG. 1, the first heat exchanger 14 has the shape of a ring so as to fill the cross section of the outer tube 24, and is disposed adjacent to the first end portion 12A side of the regenerator 18 in the outer tube 24. Furthermore, the first heat exchanger 14 is disposed inside the high-temperature heat source 28. The first heat exchanger 14 allows the heat of the high-temperature heat source 28 to move to the regenerator 18; in one example it may allow the heat to move by flowing a working fluid inside, and in another example it may allow the heat to move by utilizing radiation or thermal conduction without flowing a fluid.

(Second Heat Exchanger 16)

As shown in FIG. 1, the second heat exchanger 16 has the shape of a ring so as to fill the cross section of the outer tube 24, and is disposed adjacent to the second end portion 12B side of the regenerator 18 in the outer tube 24. Furthermore, the second heat exchanger 16 is disposed inside the low-temperature heat bath 30. That is, the second heat exchanger 16 allows the heat of the regenerator 18 to move to the low-temperature heat bath 30 by flowing a working fluid inside or by radiation or thermal conduction.

(Regenerator 18)

As shown in FIG. 1, the regenerator 18 is a structure 33 having the shape of a ring so as to fill the cross section of the outer tube 24, and in the structure 33 are formed numerous pores 34 that run along the axial direction from the first end portion 12A side to the second end portion 12B side.

The diameter of the pores 34 is set so that the dimensionless channel diameter r=R/D is about 2. Here, R denotes the diameter of the pores 34 and D denotes the thickness of thermal boundary layers formed inside the pores 34.

Figure 2:
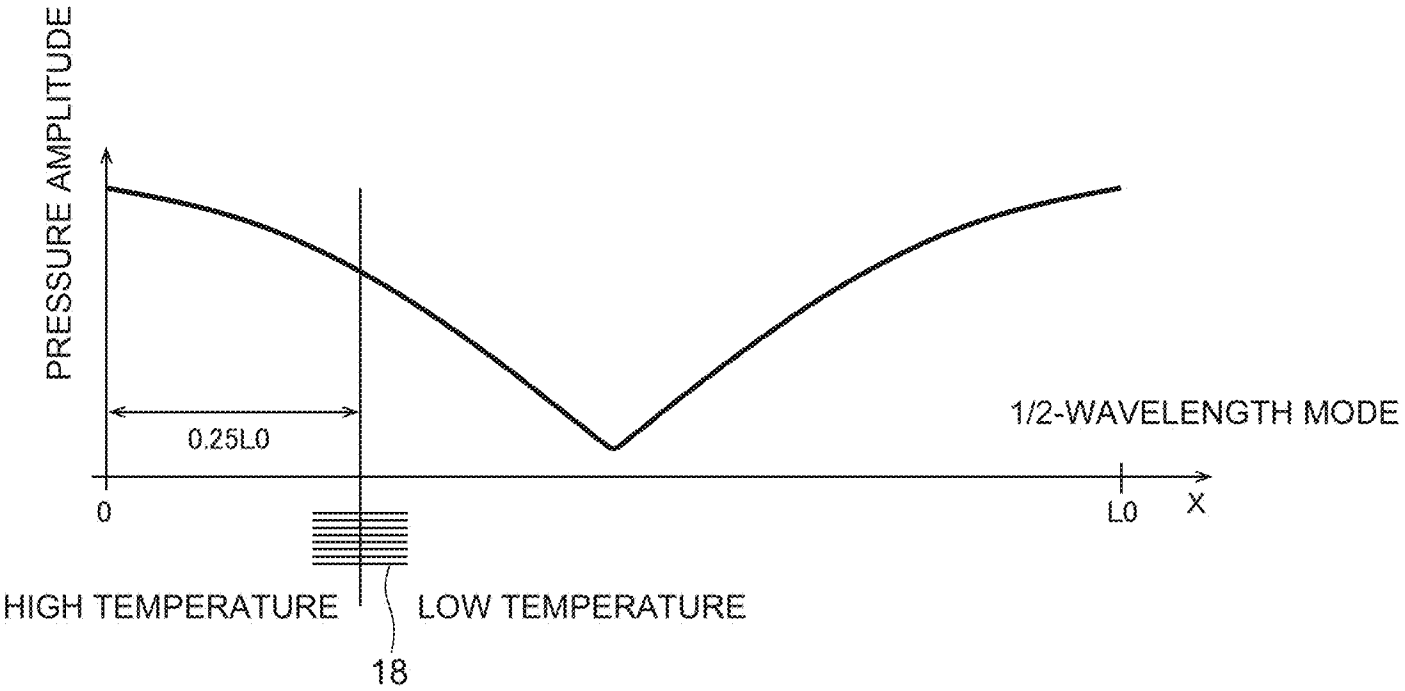
FIG. 2 is a graph showing the positional relationship between a regenerator and the pressure amplitude of a standing wave in a ½-wavelength mode produced inside the heat transfer device pertaining to the first embodiment.

Furthermore, as shown in FIG. 1 and FIG. 2, the regenerator 18 is disposed in the outer tube 24 so that its center in the direction in which the conduit extends (the axial direction) is positioned on the conduit in a position that is 25% (0.25L0) of the conduit length L0 from the closed-off surface 26.

It will be noted that although in the present embodiment the regenerator 18 has a configuration where the numerous pores 34 that run along the axial direction from the first end portion 12A side to the second end portion 12B side are formed in the structure 33 of the regenerator 18, it may also have a configuration where hole portions that run from the first end portion 12A side to the second end portion 12B side are formed by laminating, along the axial direction, plural plate-like stacks each comprising a porous medium in which are formed numerous hole portions that run from the end surface on the first end portion 12A side to the end surface on the second end portion 12B side. These hole portions are also included in the pores of the disclosure.

(Regulating Valve 20)

The regulating valve 20 has a valve body 36, which is disposed inside the tubular body 12 and has the shape of a tapered cone pointing toward the first end portion 12A side, and a shaft body 38, which extends in the axial direction from the end portion of the valve body 36 on the second end portion 12B side. The valve body 36 is configured to have a shape with a size (diameter) capable of closing off the end portion of the inner tube 22. The shaft body 38 extends outside the tubular body 12 from a hole portion 39 formed in the second end portion 12B of the tubular body 12. Furthermore, the shaft body 38 is configured to be movable forward and backward in the axial direction by a driving means not shown in the drawings. That is, the valve body 36 attached to the distal end of the shaft body 38 is configured to be movable forward and backward inside the tubular body 12.

(Operation)

The operation of the heat transfer device 10 configured in this way will be described.

In the regenerator 18 of the heat transfer device 10 disposed as in FIG. 1, a temperature gradient is produced in the regenerator 18 disposed between the first heat exchanger 14 disposed in the high-temperature heat source 28 and the second heat exchanger 16 disposed in the low-temperature heat bath 30. When the ratio (temperature ratio) between the temperature of the end portion of the regenerator 18 on the first end portion 12A side that is on the high-temperature side and the temperature of the end portion of the regenerator 18 on the second end portion 12B side that is on the low-temperature side exceeds a threshold, the gas in the pores 34 of the regenerator 18 undergoes thermoacoustic self-excited oscillations.

The thermoacoustic self-excited oscillations form a standing wave inside the tubular body 12, specifically, in the conduit X extending from the closed-off surface 26 of the outer tube 24 to the second end portion 12B side of the tubular body 12 and extending from the second end portion 12B side via the inner tube 22 to the first end portion 12A.

Here, FIG. 2 shows a case where a standing wave is formed in a ½-wavelength mode on the conduit of the tubular body 12. In FIG. 2, the X-axis represents the distance from the closed-off surface 26 on the conduit. Here, L0 represents the conduit length from the closed-off surface 26 to the first end portion 12A of the tubular body 12.

It will be noted that the regenerator 18 disposed under the X-axis in FIG. 2 represents its position on the conduit and particularly its positional relationship with the standing wave.

That is, as shown in FIG. 2, when the standing wave has been formed inside the tubular body 12, the distance from the closed-off surface 26 to the center of the regenerator 18 in the direction in which the conduit extends (the axial direction) is 0.25L0 with respect to the conduit length L0, so the regenerator 18 is disposed in the portion where the product of the pressure amplitude and the velocity amplitude is the largest, and the heat transfer amount is maximized.

In this way, in the heat transfer device 10 pertaining to the present embodiment, when a temperature gradient is produced inside the regenerator 18 and the temperature ratio between both end portions of the regenerator 18 exceeds the threshold, this produces thermoacoustic self-excited oscillations and also generates inside the tubular body 12 a standing wave based on the thermoacoustic self-excited oscillations. Moreover, because the center of the regenerator 18 in the direction in which the conduit extends is disposed on the conduit in a position that is 25% (0.25L0) of the conduit length L0 from the closed-off surface 26, the pressure amplitude of the standing wave monotonically decreases heading from the high-temperature side to the low-temperature side of the regenerator 18, and heat can be transferred from the high-temperature side to the low-temperature side inside the regenerator 18. That is, the heat of the high-temperature heat source 28 can be transferred via the first heat exchanger 14, the regenerator 18, and the second heat exchanger 16 to the low-temperature heat bath 30.

Furthermore, because the center of the regenerator 18 in the direction in which the conduit extends is disposed on the conduit in a position that is 0.25L0 from the closed-off surface 26, the center of the regenerator 18 in the direction in which the conduit extends is disposed in the position where the product of the pressure amplitude and the velocity amplitude of the standing wave reaches a maximum, and the amount of heat transfer by the regenerator 18 is maximized. Consequently, the heat transfer device 10 can efficiently transfer heat from the high-temperature heat source 28 to the low-temperature heat bath 30.

Moreover, part of the tubular body 12 of the heat transfer device 10 is given a double-tube structure having the inner tube 22 and the outer tube 24, and the conduit X that extends from the end portion of the outer tube 24 on the high-temperature heat source side (the closed-off surface 26) to the end portion of the tubular body 12 on the high-temperature heat source side (the first end portion 12A) is formed. Consequently, the proportion of the total volume of the tubular body 12 occupied by the volume of the portion of the tubular body 12 that projects on the low-temperature heat bath 30 side is kept down (downsized). In other words, the volume of the portion of the tubular body 12 that projects on the high-temperature heat source 28 side becomes greater, so the area of heat transfer from the high-temperature heat source 28 to the tubular body 12 increases, and the heat transfer efficiency of the heat transfer device 10 is further improved.

It will be noted that if the temperature difference between the end portion of the regenerator 18 on the high-temperature side and the end portion of the regenerator 18 on the low-temperature side greatly exceeds the threshold, sometimes a standing wave in a 1-wavelength mode caused by an acoustic self-excited wave is generated inside the conduit X. In this case, heat transfer inside the regenerator 18 also takes place because of the standing wave in the 1-wavelength mode, and the heat transfer efficiency of the heat transfer device 10 is further improved.

Furthermore, in the heat transfer device 10, by using the thermoacoustic self-excited oscillations, heat transfer can be performed without a drive source (power supply) such as a pump. Consequently, the manufacturing cost and the running cost of the heat transfer device 10 can be reduced. Furthermore, the heat transfer device 10 is maintenance-free because the heat transfer itself does not have a drive source.

Moreover, the heat transfer device 10 uses, as is in its gas form, the nitrogen gas sealed inside the tubular body 12, and does not use a phase change from liquid to gas, so there is no concern that the working fluid (in the present embodiment, the nitrogen gas) will explode, and the heat transfer device 10 is very safe.

Figure 3:
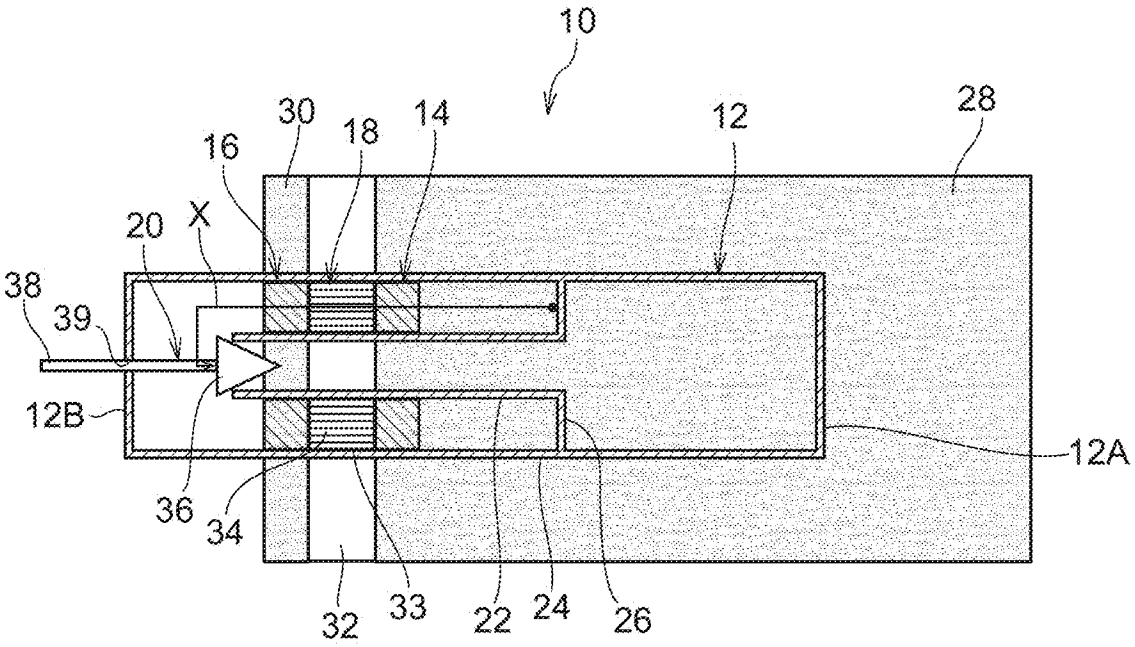
FIG. 3 is a general configuration diagram showing when a regulating valve is closing off an inner tube in the heat transfer device pertaining to the first embodiment.

Moreover, in the heat transfer device 10, the valve body 36 can be moved toward and away from the end portion side of the inner tube 22 by driving with a non-illustrated drive source of the regulating valve 20. As shown in FIG. 3, when the valve body 36 closes off the end portion (the open portion) of the inner tube 22, the conduit X in which the standing wave is formed is shortened from the closed-off surface 26 to the valve body 36. That is, the conduit length is shortened from L0 to L1.

Figure 4:
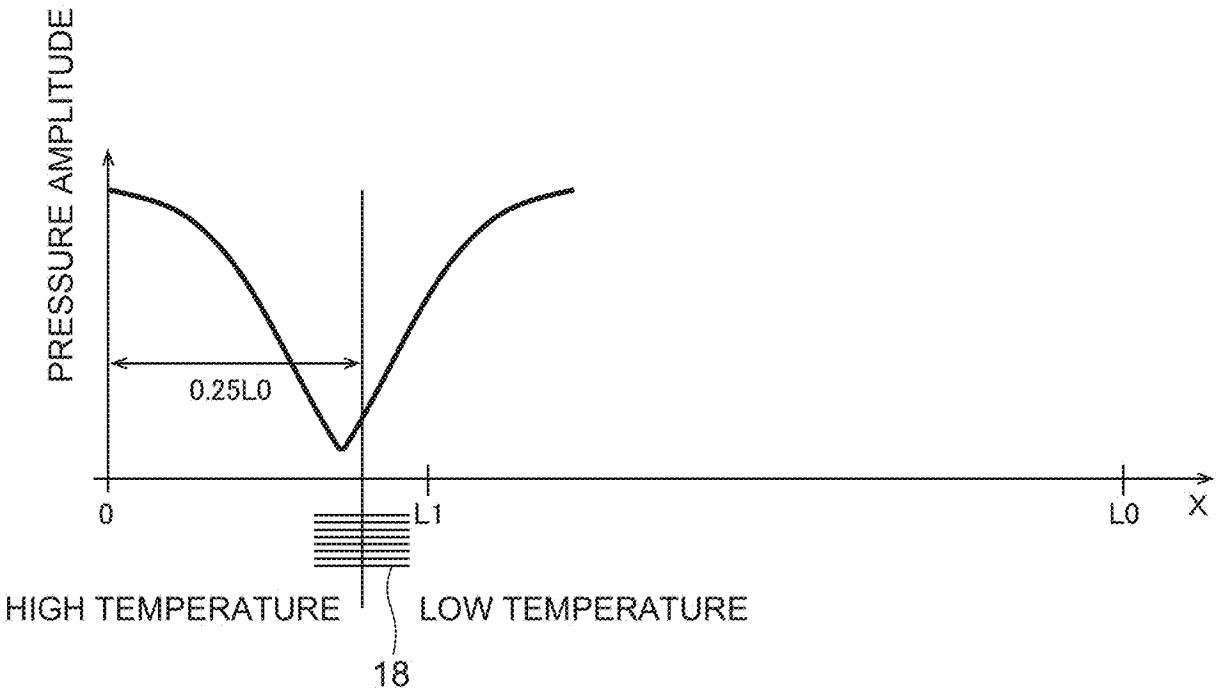
FIG. 4 is a graph showing the positional relationship between the regenerator and the pressure amplitude of the standing wave in the ½-wavelength mode produced inside the heat transfer device when the inner tube is closed off.

As a result, as shown in FIG. 4, the waveform (wavelength) of the standing wave in the ½-wavelength mode is shortened, the relative position of the regenerator 18 with respect to the standing wave changes, and there is no longer the relationship where the pressure amplitude monotonically decreases from the high-temperature side to the low-temperature side of the regenerator 18. That is, the thermoacoustic self-excited oscillations are no longer produced even when a temperature gradient is produced between both end portions of the regenerator 18. Because of this, the heat transfer of the regenerator 18 is stopped.

Figure 5:
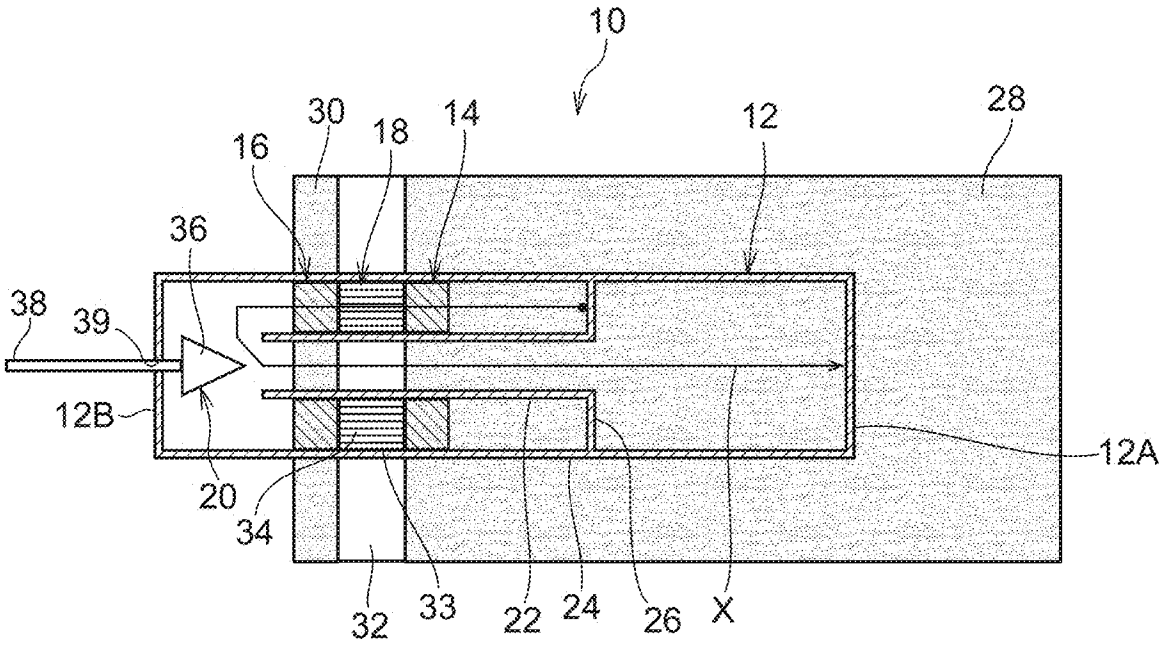
FIG. 5 is a general configuration diagram showing when the regulating valve is regulating a conduit length in the heat transfer device pertaining to the first embodiment.
Figure 6:
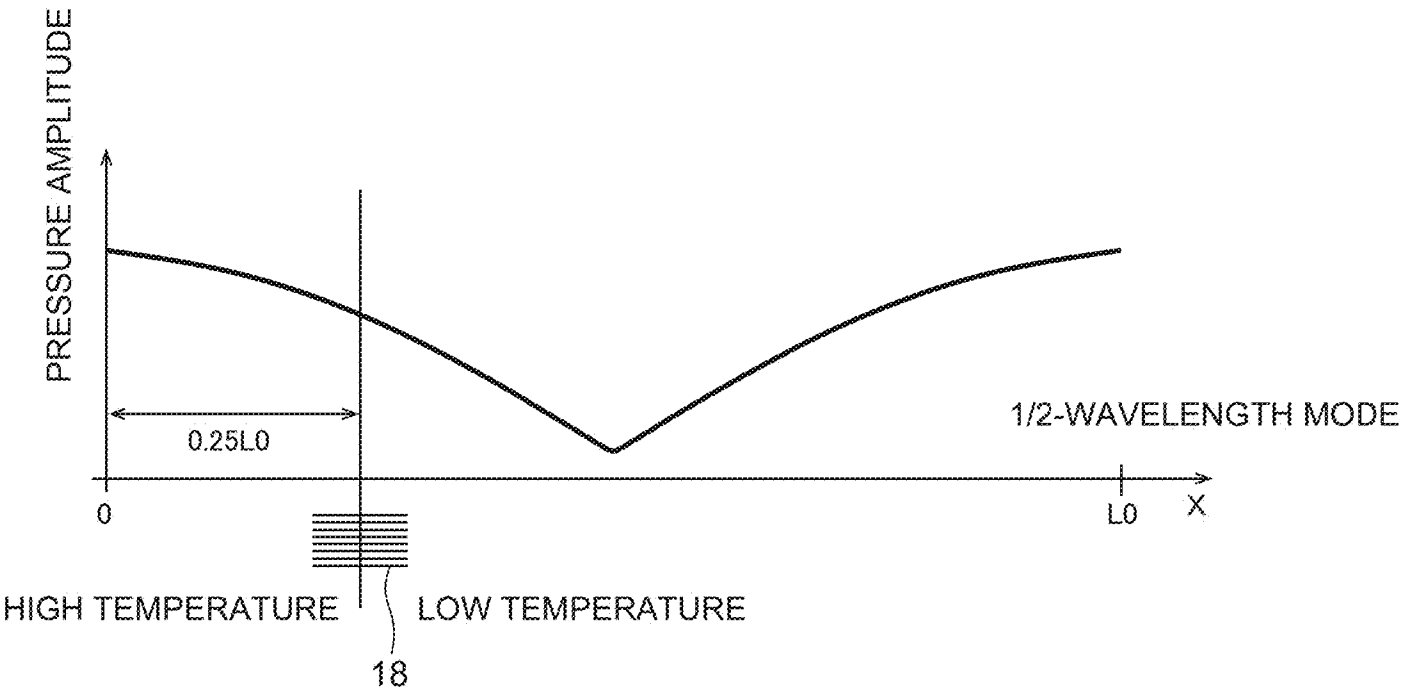
FIG. 6 is a graph showing the positional relationship between the regenerator and the pressure amplitude of the standing wave in the ½-wavelength mode produced inside the heat transfer device when the conduit length is being regulated.

Moreover, as shown in FIG. 5, by regulating how far the regulating valve 20 is moved inside the tubular body 12 (how close it is to the end portion of the inner tube 22) to the extent that the regulating valve 20 does not abut against the end portion of the inner tube 22, the waveform (amplitude) of the standing wave can be changed. Specifically, as shown in FIG. 6, the pressure amplitude of the standing wave can be changed (e.g., reduced) overall. As a result, the product of the pressure amplitude and the velocity amplitude at the position where the regenerator 18 is disposed can be changed to thereby regulate the amount of heat transfer (thermal conductivity) by the regenerator 18.

Applied Example

An example where the heat transfer device 10 is applied to an industrial furnace 40 will be described with reference to FIG. 7 to FIG. 9C. It will be noted regarding the constituent elements of the heat transfer device 10 that the same reference signs as those of the above embodiment are assigned thereto and detailed description thereof will be omitted.

Figure 7:
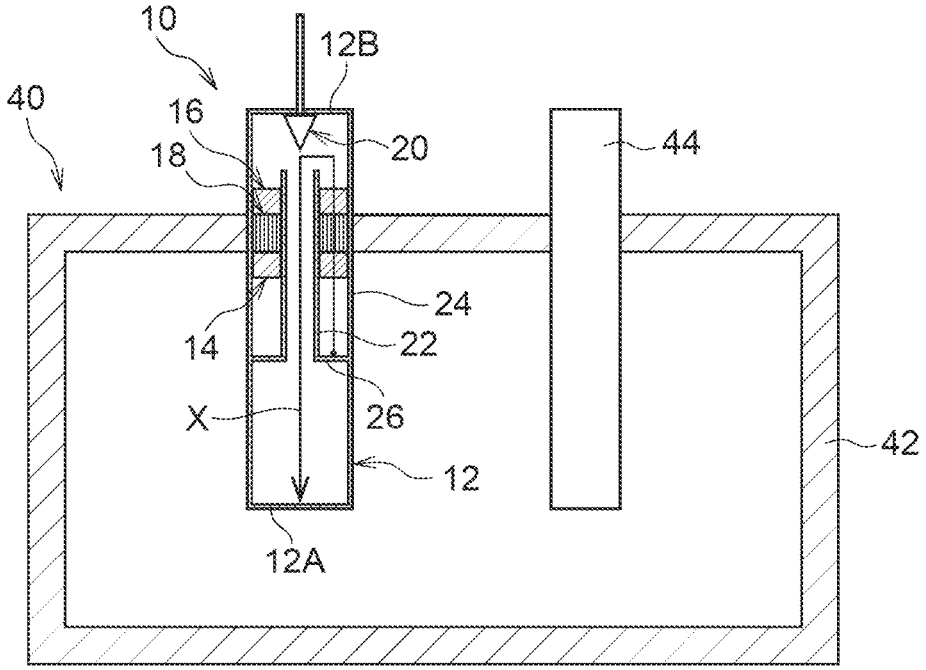
FIG. 7 is a general explanatory diagram of an example where the heat transfer device pertaining to the first embodiment is applied to a furnace.

As shown in FIG. 7, the furnace 40 is formed by insulation 42 in the shape of a rectangular body that is a closed space, and parts of a heater 44 and the heat transfer device 10 are inserted inside the furnace 40 from the upper wall thereof. The heater 44 is driven by a drive source not shown in the drawings, whereby it heats a gas inside the insulation 42, raises the temperature inside the furnace 40 to a predetermined temperature, and keeps (maintains) the temperature at the predetermined temperature.

The heat transfer device 10 is used to reject the heat inside the furnace to the outside in order to reduce the temperature inside the furnace 40 after the driving of the furnace 40 ends. The first end portion 12A side of the heat transfer device 10 is inserted inside the furnace 40, and the second end portion 12B side is disposed projecting outside the furnace 40. Specifically, in the axial direction of the heat transfer device 10 (the tubular body 12), the portion from the first end portion 12A of the tubular body 12 to the end portion of the first heat exchanger 14 is inserted inside the furnace 40, and the portion from the end portion of the second heat exchanger 16 to the second end portion 12B is disposed outside the furnace 40. Furthermore, the regenerator 18 of the heat transfer device 10 is disposed in the position of the insulation 42 of the furnace 40.

The operation resulting from the heat transfer device 10 being disposed in the furnace 40 in this way will be described by way of a comparison with a furnace 46 of a comparative example in which the heat transfer device 10 is not disposed.

Figure 9A:
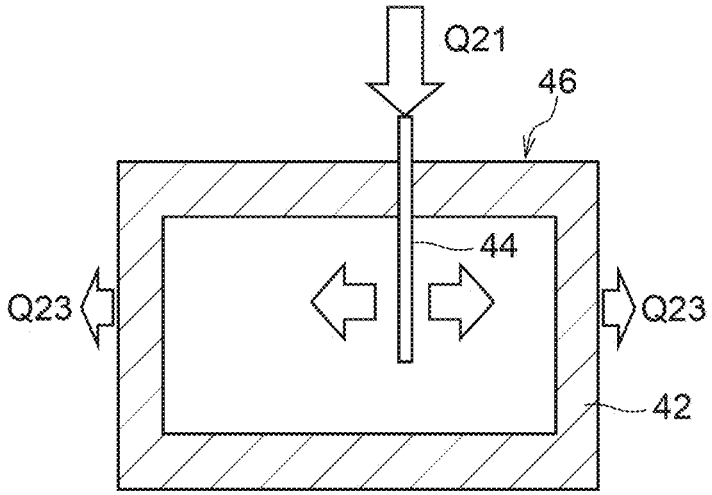
FIG. 9A is a schematic diagram describing heat transfer when raising the temperature in a furnace pertaining to a comparative example.
Figure 9B:
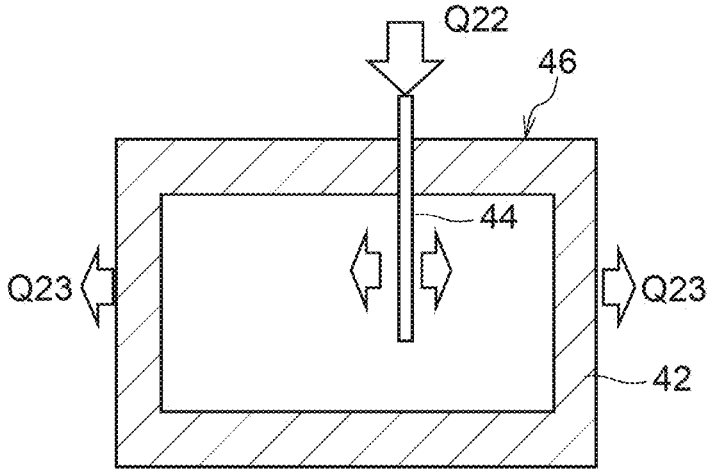
FIG. 9B is a schematic diagram describing heat transfer when maintaining the temperature in the furnace pertaining to the comparative example.
Figure 9C:
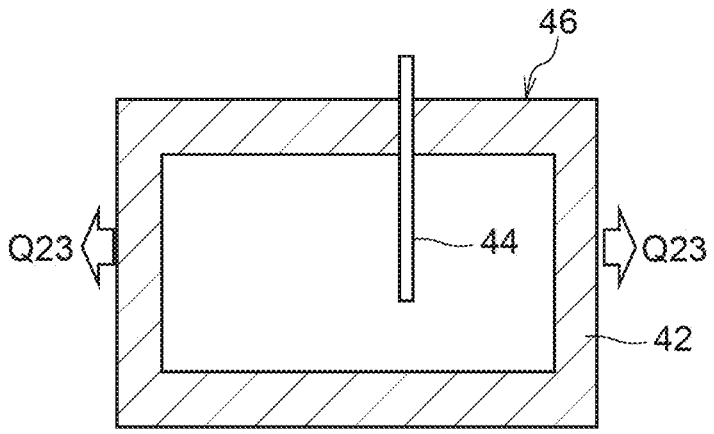
FIG. 9C is a schematic diagram describing heat transfer when lowering the temperature in the furnace pertaining to the comparative example.

The furnace 46 pertaining to the comparative example does not have a heat transfer device that rejects heat, so as shown in FIG. 9C, cooling inside the furnace takes place because of natural heat dissipation via the insulation 42 based on the temperature difference between the inside of the furnace and the outside of the furnace. To increase a quantity of heat Q23 resulting from natural heat dissipation, it is conceivable to reduce the thickness of the insulation 42 and thereby lower the insulating property. However, increasing the quantity of heat Q23 resulting from natural heat dissipation leads to an increase in a quantity of heat Q21 input to the furnace from the heater 44 when raising the temperature as shown in FIG. 9A and a quantity of heat Q22 input to the furnace from the heater 44 when maintaining the temperature as shown in FIG. 9B. Consequently, it is difficult to efficiently reject the heat inside the furnace.

Figure 8A:
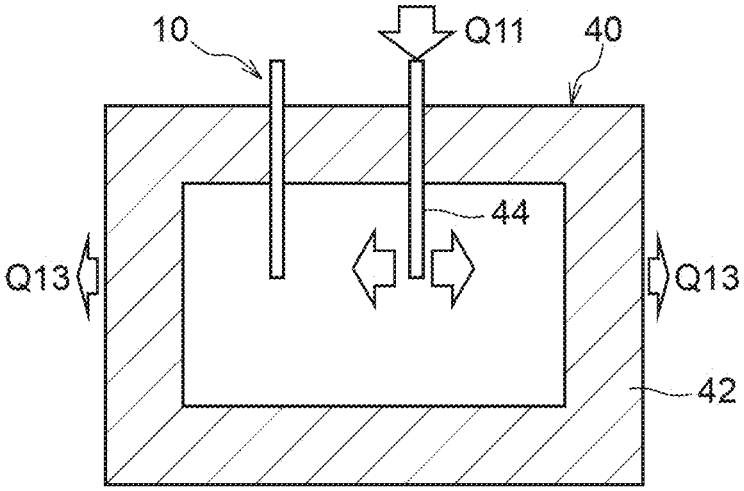
FIG. 8A is a schematic diagram describing heat transfer when raising the temperature in the example where the heat transfer device pertaining to the first embodiment is applied to the furnace.

In contrast, in the furnace 40 in which the heat transfer device 10 is disposed, when raising the temperature inside the furnace 40, as shown in FIG. 8A, the heater 44 is driven and a quantity of heat Q11 is input to the furnace. Because of the temperature difference between the inside and the outside of the furnace 40, a quantity of heat Q13 is rejected from the inside of the furnace. It will be noted that when the valve body 36 of the regulating valve 20 closes off the end portion of the inner tube 22 (see FIG. 3), the thermoacoustic self-excited oscillations are not produced in the regenerator 18 and the heat transfer of the heat transfer device 10 is stopped. Consequently, the temperature inside the furnace 40 increases in accordance with the difference between the quantity of heat Q11 that is input and the quantity of heat Q13 that is rejected.

Figure 8B:
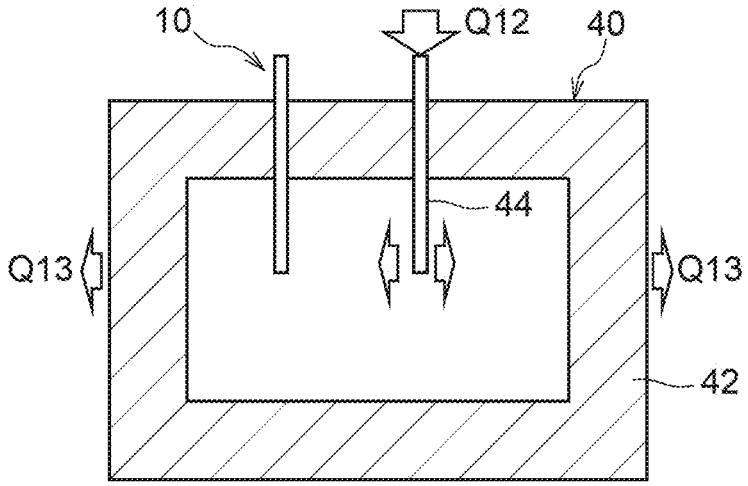
FIG. 8B is a schematic diagram describing heat transfer when maintaining the temperature in the example where the heat transfer device pertaining to the first embodiment is applied to the furnace.

Next, when keeping (maintaining) the temperature inside the furnace 40, as shown in FIG. 8B, the heater 44 is driven and a quantity of heat Q12 equal to the quantity of heat Q13 rejected from the furnace 40 is input to the furnace. In this case also, the heat transfer of the heat transfer device 10 is stopped. Consequently, the temperature inside the furnace 40 is kept (maintained) as is.

Figure 8C:
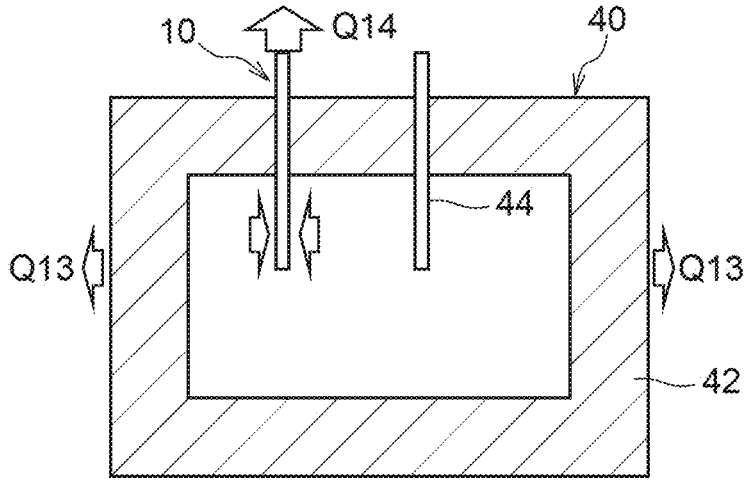
FIG. 8C is a schematic diagram describing heat transfer when lowering the temperature in the example where the heat transfer device pertaining to the first embodiment is applied to the furnace.

Moreover, when lowering the temperature inside the furnace 40, the valve body 36 of the regulating valve 20 of the heat transfer device 10 is moved to the second end portion 12B of the tubular body 12 to thereby open the end portion of the inner tube 22 (see FIG. 1). Because of this, as shown in FIG. 8C, thermoacoustic self-excited oscillations are produced based on the difference between the temperature inside and the temperature outside the furnace 40, and the heat transfer device 10 transfers (rejects) a quantity of heat Q14 from the inside of the furnace to the outside of the furnace. In this way, the quantity of heat Q14 rejected by the heat transfer device 10 and the quantity of heat Q13 rejected by natural heat dissipation from the insulation 42 are rejected from the inside of the furnace to the outside of the furnace, so the temperature inside the furnace can be efficiently lowered. Furthermore, the heat output is large compared to the case of only natural heat dissipation from the insulation 42 as in the furnace 46 of the comparative example, so it is not necessary to reduce the thickness of the insulation 42 for heat dissipation, and thermal efficiency when raising the temperature and when maintaining the temperature can be kept high.

Furthermore, in the heat transfer device 10, part of the tubular body 12 is given a double-tube structure comprising the inner tube 22 and the outer tube 24, and the regenerator 18, the first heat exchanger 14, and the second heat exchanger 16 are disposed in the outer tube 24, so the volume of the portion of the tubular body 12 on the second end portion 12B side disposed outside the furnace 40 and its proportion with respect to the total are kept down, and so the attachability of the heat transfer device 10 to the existing furnace 40 is excellent.

The volume of the portion of the tubular body 10 of the heat transfer device 10 disposed inside the furnace is large, so the area of heat transfer from (the gas inside) the furnace 40 with respect to the tubular body 12 increases. Because of this, the efficiency with which the heat transfer device 10 transfers heat from the inside of the furnace to the outside of the furnace is improved even more.

Moreover, the gas (nitrogen gas) that is the working fluid is sealed inside the tubular body 12 of the heat transfer device 10, so the gas inside the furnace and the gas in the heat transfer device 10 do not mix with each other and the environment inside the furnace is protected.

Furthermore, the nitrogen gas inside the heat transfer device 10 is utilized as is in its gas form, that is, the heat transfer device 10 does not use a phase change from liquid to gas, so the danger of a gas explosion is avoided, and the heat transfer device 10 is very safe even when it is used in the industrial furnace 40 whose use temperature is high (e.g., 500° C.).

Second Embodiment (Device Configuration)

A heat transfer device pertaining to a second embodiment of the disclosure will be described with reference to FIG. 10. Regarding constituent elements that are the same as those of the first embodiment, the same reference signs are assigned thereto and detailed description thereof will be omitted. It will be noted that only points that are different from the first embodiment will be described.

Figure 10:
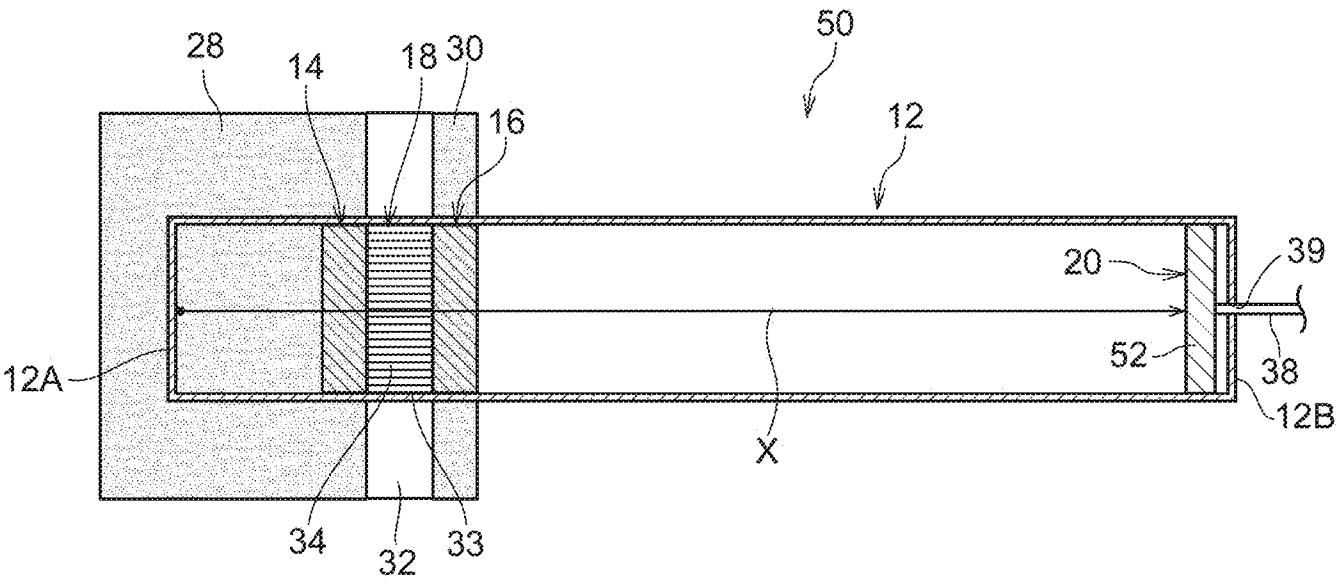
FIG. 10 is a general configuration diagram of a heat transfer device pertaining to a second embodiment.

As shown in FIG. 10, a heat transfer device 50 is given a single-tube structure in which the double-tube structure that had been formed in part of the tubular body 12 of the heat transfer device 10 is removed. Consequently, in this heat transfer device 50, the conduit X is formed from the first end portion 12A to the second end portion 12B of the tubular body 12. It will be noted that in the heat transfer device 50, the distance along the conduit (the axial direction) from the first end portion 12A to the regulating valve 20 on the second end portion 12B side is the conduit length L0.

The first heat exchanger 14, the second heat exchanger 16, and the regenerator 18 are disposed in the entire cross section of the tubular body 12. The regenerator 18 is disposed so that its center in the direction in which the conduit extends (the axial direction) is positioned on the conduit X in a position that is 25% (0.25L0) of the conduit length L0 from the first end portion 12A. As a result, the axial direction length of the tubular body 12 disposed in the low-temperature heat bath 30 (the outer side of the insulating member 32) is longer than the axial direction length of the tubular body 12 disposed inside the high-temperature heat source 28.

Furthermore, in the heat transfer device 50, the regulating valve 20 is disposed in the second end portion 12B of the tubular body 12. A valve body 52 of the regulating valve 20 is configured in a disc shape that is the same as the cross-sectional shape (e.g., circular shape) of the tubular body 12. Furthermore, the shaft body 38 of the regulating valve 20 is configured to be movable forward and backward in the axial direction by a drive source not shown in the drawings. That is, when the valve body 52 of the regulating valve 20 is moved forward and backward in the axial direction of the tubular body 12, the conduit length is regulated.

(Operation)

The operation of the heat transfer device 50 configured in this way will be described. It will be noted that description will be simplified or omitted regarding operation that is the same as that of the heat transfer device 10.

In the heat transfer device 50, thermoelectric self-excited oscillations are produced inside the regenerator 18 and a standing wave based on the thermoacoustic self-excited oscillations is generated inside the tubular body 12. Furthermore, in the heat transfer device 50, the regenerator 18 is disposed in such a way that the pressure amplitude of the standing wave monotonically decreases from the high-temperature side to the low-temperature side (see FIG. 2), so heat can be transferred from the high-temperature heat source 28 to the low-temperature heat bath 30.

Moreover, because the center of the regenerator 18 in the direction in which the conduit extends is disposed on the conduit in a position that is 0.25L0 from the first end portion 12A, the center of the regenerator 18 in the direction in which the conduit extends is disposed in the position where the product of the pressure amplitude and the velocity amplitude of the standing wave reaches a maximum, and the amount of heat transfer by the regenerator 18 is maximized. Consequently, the heat transfer device 50 can efficiently transfer heat from the high-temperature heat source 28 to the low-temperature heat bath 30.

Furthermore, in the heat transfer device 50, the valve body 52 can be moved toward and away from the first end portion 12A (the second heat exchanger 16) side of the tubular body 12 by driving the non-illustrated drive source of the regulating valve 20. This changes the conduit length of the conduit X in which the standing wave is formed, thereby changing the relative positional relationship between the standing wave and the regenerator 18. As a result, the product of the pressure amplitude and the velocity amplitude at the position where the regenerator 18 is disposed can be changed to regulate the amount of heat transfer by the heat transfer device 50 (the regenerator 18).

Moreover, depending on the change in the relative positional relationship between the standing wave and the regenerator 18, there is no longer the relationship where the pressure amplitude of the standing wave monotonically decreases from the high-temperature side to the low-temperature side of the regenerator 18. That is, the thermoacoustic self-excited oscillations are no longer produced even when a temperature gradient is produced in the regenerator 18, and the heat transfer of the heat transfer device 50 (the regenerator 18) is stopped.

That is, in the heat transfer device 50, by moving the regulating valve 20 forward and backward in the axial direction, the heat transfer can be stopped (the generation of the standing wave can be stopped) and the heat transfer amount (thermal conductivity) can be regulated.

Applied Example

Figure 11:
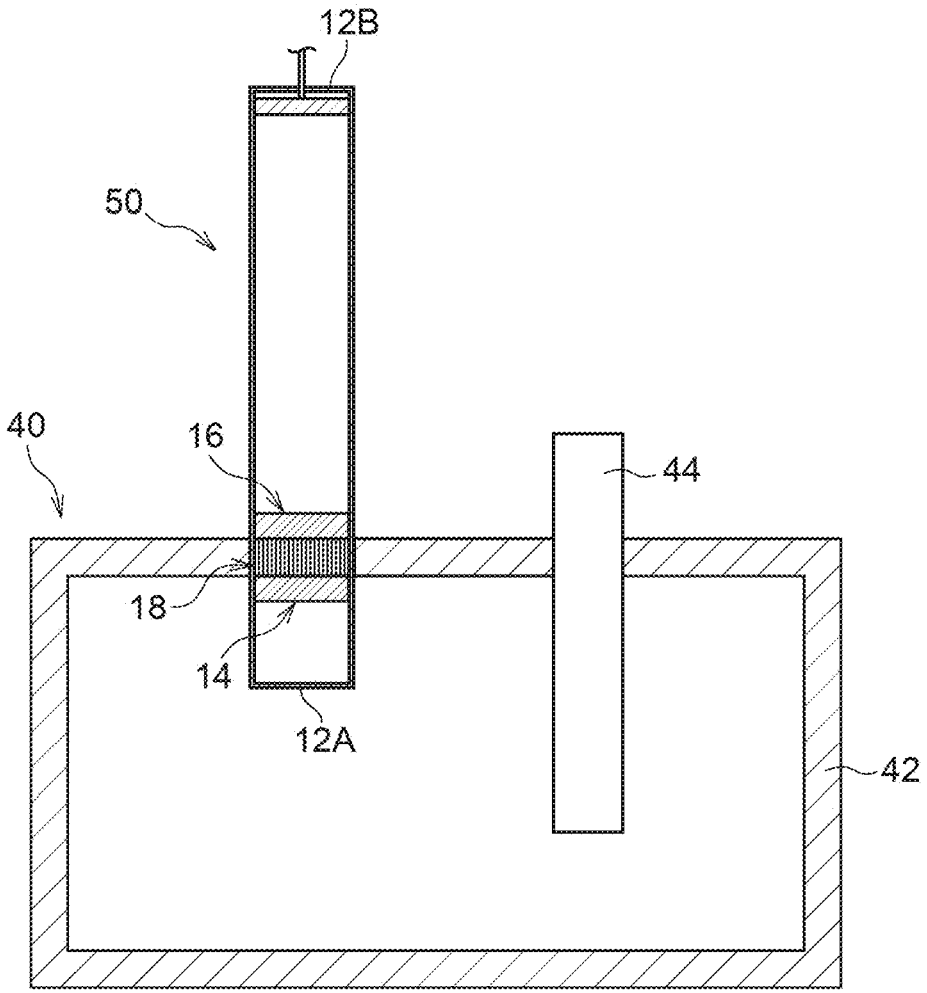
FIG. 11 is a general explanatory diagram of an example where the heat transfer device pertaining to the second embodiment is applied to a furnace.

An example where the heat transfer device 50 is applied to the industrial furnace 40 will be described with reference to FIG. 11. It will be noted regarding the constituent elements of the heat transfer device 50 that the same reference signs as those of the above embodiment are assigned thereto and detailed description thereof will be omitted. Furthermore, the industrial furnace also has the same configuration as the furnace to which the heat transfer device 10 was applied, so the same reference signs are assigned thereto and detailed description thereof will be omitted.

The heat transfer device 50 attached to the furnace 40 has its first end portion 12A side inserted inside the furnace 40 and its second end portion 12B side disposed projecting outside the furnace 40. Specifically, in the axial direction of the heat transfer device 50 the portion from the first end portion 12A to the end portion of the first heat exchanger 14 is inserted inside the furnace 40, and the portion from the end portion of the second heat exchanger 16 to the second end portion 12B is disposed outside the furnace 40. Consequently, the regenerator 18 is disposed in the position of the insulation 42.

Because the heat transfer device 50 is disposed in the furnace 40 in this way, the thermoacoustic self-excited oscillations are produced in the regenerator 18 based on the temperature difference between the temperature inside the furnace 40 and the temperature outside the furnace 40, the standing wave is generated inside the tubular body 12, and the heat inside the furnace 40 is efficiently rejected from the first heat exchanger 14 via the regenerator 18 to the second heat exchanger 16 based on the gradient of the pressure amplitude of the standing wave.

Furthermore, the heat transfer device 50 simply has the first heat exchanger 14, the second heat exchanger 16, and the regenerator 18 disposed inside the tubular body 12 that is a single tube, so its structure is simple and it is easy to manufacture.

Moreover, the heat transfer device 50 has the advantage that the proportion of the tubular body 12 inserted inside the furnace 40 can be reduced.

Experimental Examples and Numerical Calculation Examples

Figure 12:
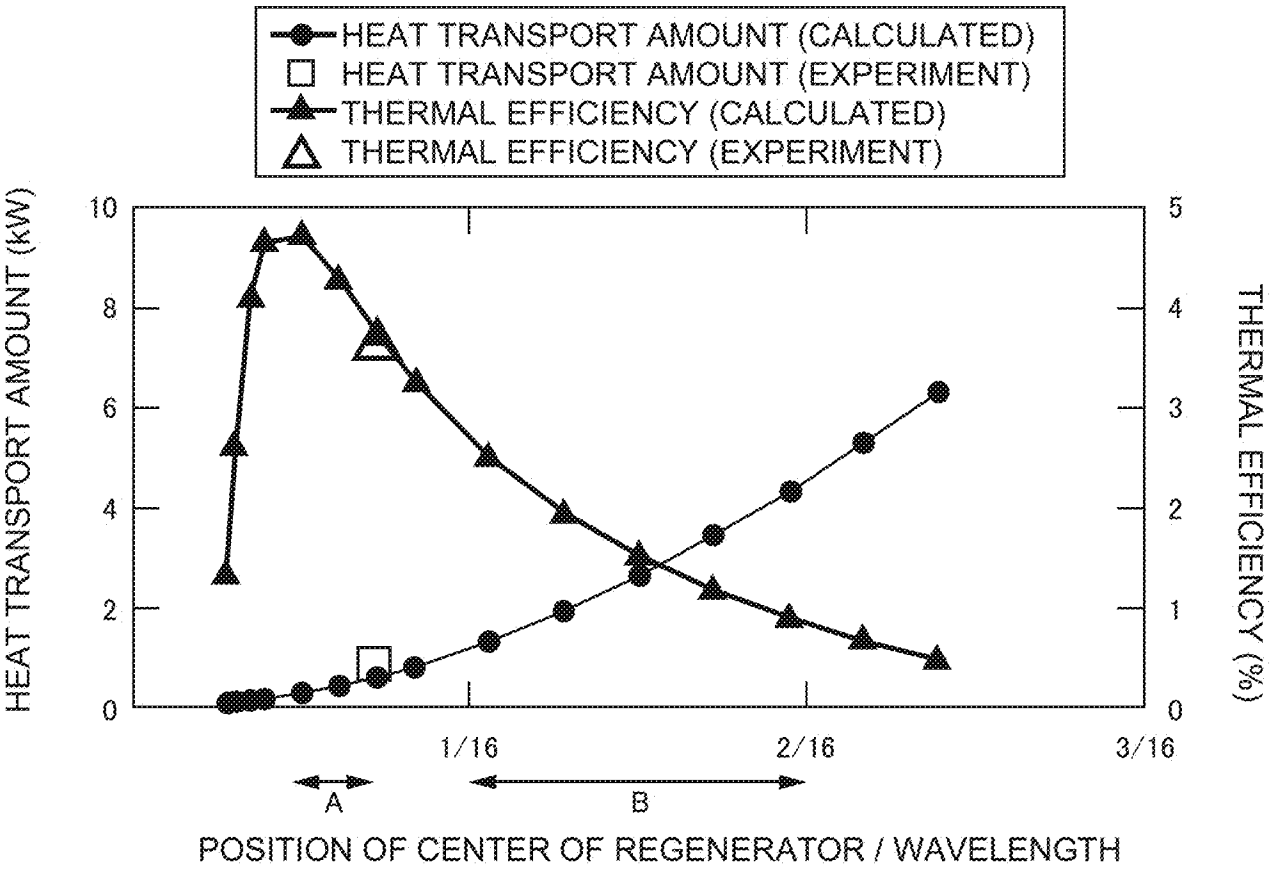
FIG. 12 is a graph showing numerical calculation results and experimental results demonstrating the relationship between the position of the regenerator inside the heat transfer device pertaining to the second embodiment and thermal efficiency and heat transfer amount.

Using the heat transfer device with the single tube (tubular body) of the second embodiment, thermal efficiencies (%) and heat transfer amounts (kw) were found by numerical calculation based on thermoacoustic theory with respect to heat transfer devices in which the position of the regenerator inside the tubular body in the direction in which the conduit extends was changed (see FIG. 12 and Kenta NAKAMURA and Yuki UEDA, "Design and Construction of aStanding-Wave Thermoacoustic Engine with Heat Sources Having a Given Temperature Ratio," *Journal of Thermal Science and Technology,* 2011, vol 6, No 3, p 416-423).

Specifically, the diameter of the tubular body in the heat transfer devices was set to 0.1 m, total length was set to 3.5 m, and the axial direction (the direction in which the conduit extends) length of the regenerator inserted therein was set to 0.09 m. Furthermore, the temperature of the high-temperature heat source was set to 450° C., and the temperature of the low-temperature heat source was set to 60° C.

A standing wave in the ½-wavelength mode was generated inside (the conduit of) the tubular body, the pressure amplitude was set to 20 kPa at the closed end (see the first end portion 12A of the tubular body in FIG. 10), and the heat transfer amount and the thermal efficiency were found by numerical calculation using as a parameter the distance from the closed end to the center of the regenerator in the axial direction.

Here, thermal efficiency is output work/heat input. Furthermore, output work=heat input−heat output. That is, thermal efficiency=(heat input−heat output)/heat input. Furthermore, this means that the heat transfer amount=heat input. That is, the heat transfer amount is the quantity of heat that reaches the regenerator via the first heat exchanger from the high-temperature heat source.

As shown in FIG. 12, thermal efficiency reaches a maximum when the center of the regenerator is positioned at 1/32 wavelength from the end portion of the regenerator on the high-temperature side (the closed end), and thereafter it gradually falls.

The heat transfer amount increases as the center of the regenerator is moved away from the end portion on the high-temperature side from when the regenerator is disposed so that the center of the regenerator is positioned at 1/48 wavelength from the end portion of the regenerator on the high-temperature side.

In conventional thermoacoustic engines, because it is desired to enhance thermal efficiency, in the graph of FIG. 12 the center of the regenerator is disposed in range A from about 1/32 wavelength to about 3/64 wavelength from the end portion of the conduit on the high-temperature side.

In contrast, the heat transfer device of the present embodiment performs heat transfer, so it is preferred that its heat transfer amount be as large as possible. The more the center of the regenerator is moved away from the end portion of the conduit on the high-temperature side, the larger the heat transfer amount becomes, but if thermal efficiency becomes less than 1% there is the concern that the thermoacoustic self-excited wave itself will no longer be generated because of dissipation of heat not considered in numerical calculation. Thus, by installing the center of the regenerator in the range of 1/16 wavelength to 1/8 wavelength (range B in FIG. 12) from the end portion of the conduit on the high-temperature side, it was confirmed that a heat transfer device with a large heat transfer amount (suitable for heat transfer) could be found.

It will be noted that the white triangle in the drawing is thermal efficiency measured in a experimental heat transfer device of the same size as in the numerical calculation, and the white square in the drawing is the result of heat transfer amount measured in the experimental heat transfer device. Because of this, it was confirmed that the numerical calculation result well approximated the actual experimental result.

Third Embodiment (Device Configuration)

As a third embodiment of the disclosure, an industrial furnace to which the heat transfer device pertaining to the first embodiment has been applied will be described with reference to the FIG. 13 to FIG. 19. Regarding constituent elements that are the same as those of the first embodiment, the same reference signs are assigned thereto and description thereof will be omitted.

Figure 13:
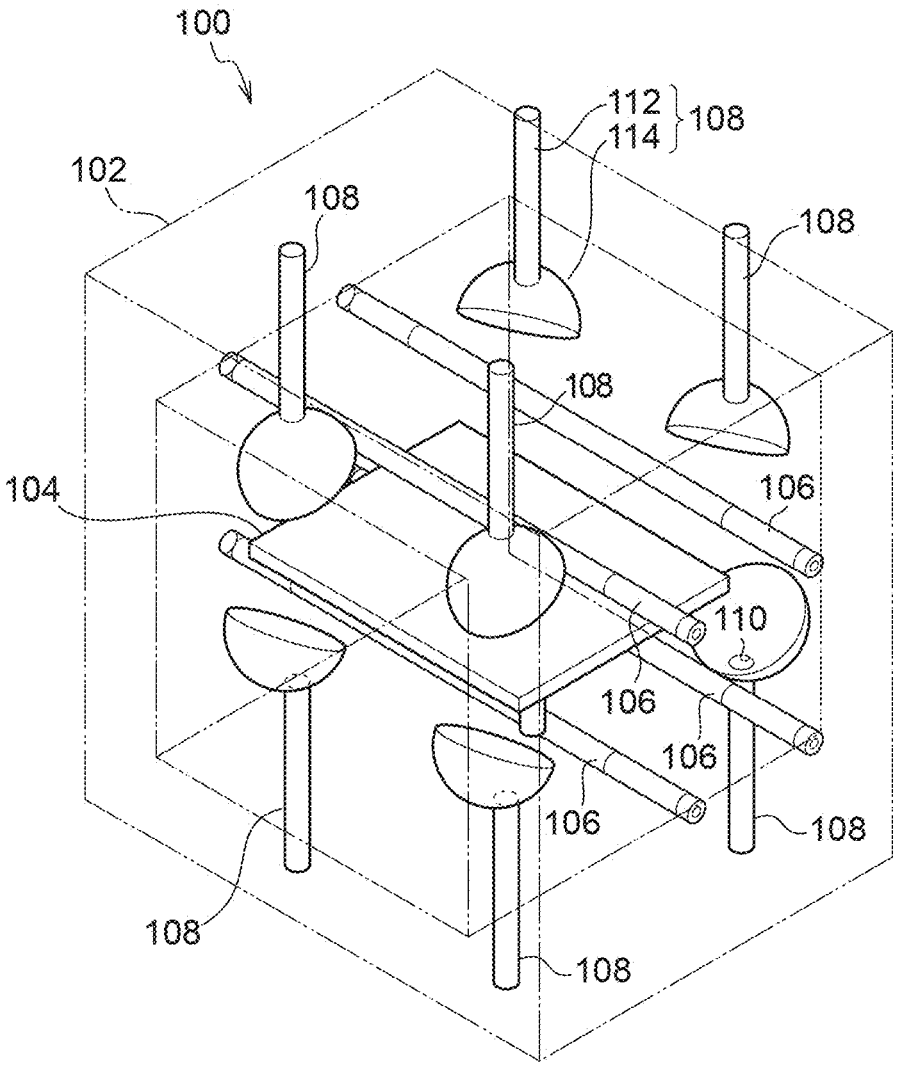
FIG. 13 is a general perspective view showing a furnace pertaining to a third embodiment when it is being heated.

As shown in FIG. 13, a furnace 100 has a rectangular furnace wall 102 comprising insulation, a worktable 104 on which is placed a work W (see FIG. 16) to be processed in an inside circumscribed by the furnace wall 102 (hereinafter called "(the) inside (of) the furnace"), heaters 106 that regulate (raise) the temperature inside the furnace to a predetermined temperature, the heat transfer device 10 (see FIG. 15 and FIG. 16), and reflector units 108.

As for the heaters 106, two are arranged in parallel running between opposing sides of the furnace wall 102 on the upper side of the worktable 104, and two are similarly arranged in parallel running between the opposing sides of the furnace wall 102 on the lower side of the worktable 104.

Figure 14:
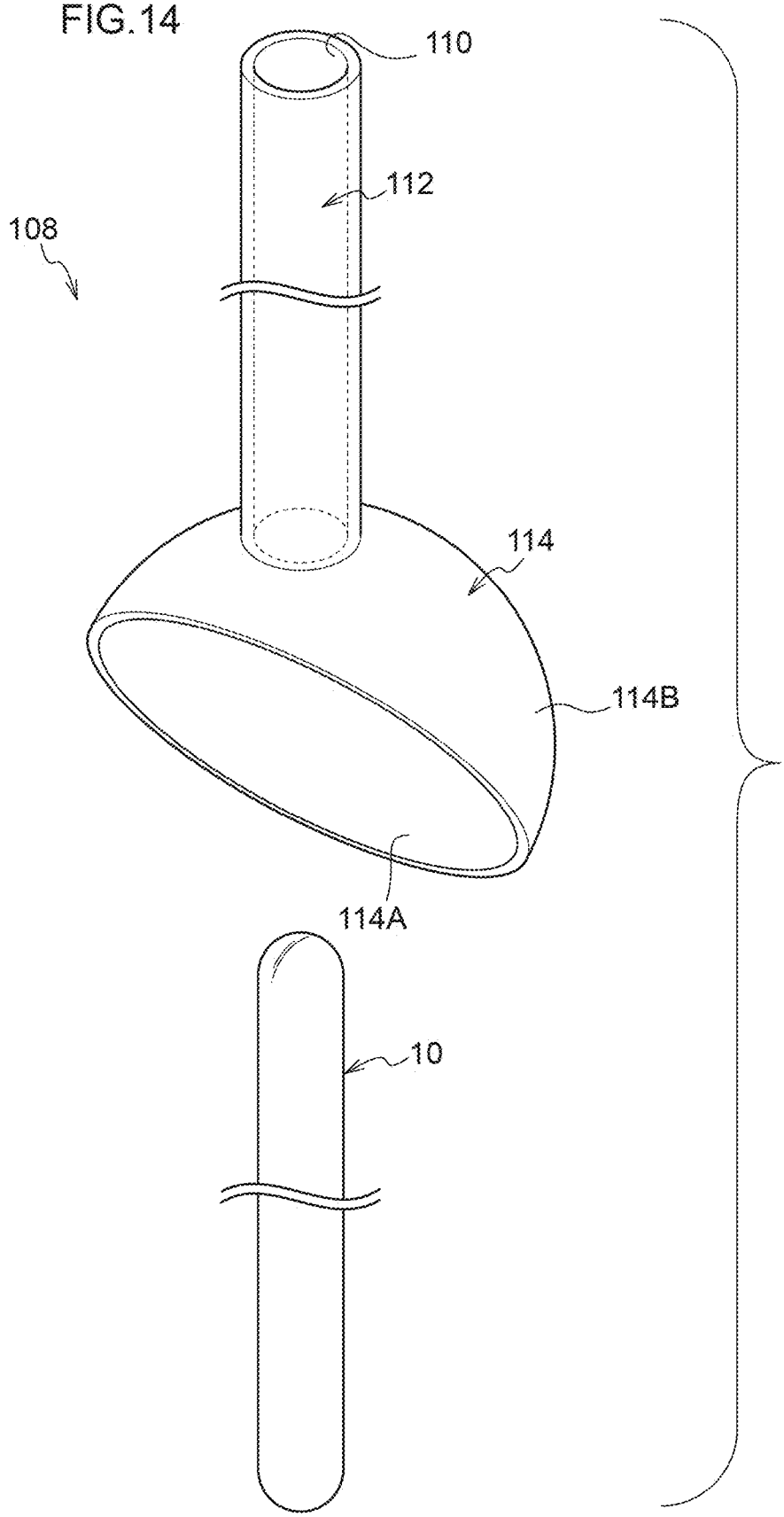
FIG. 14 is an exploded perspective view showing a reflector unit and the heat transfer device pertaining to the third embodiment.
Figure 15:
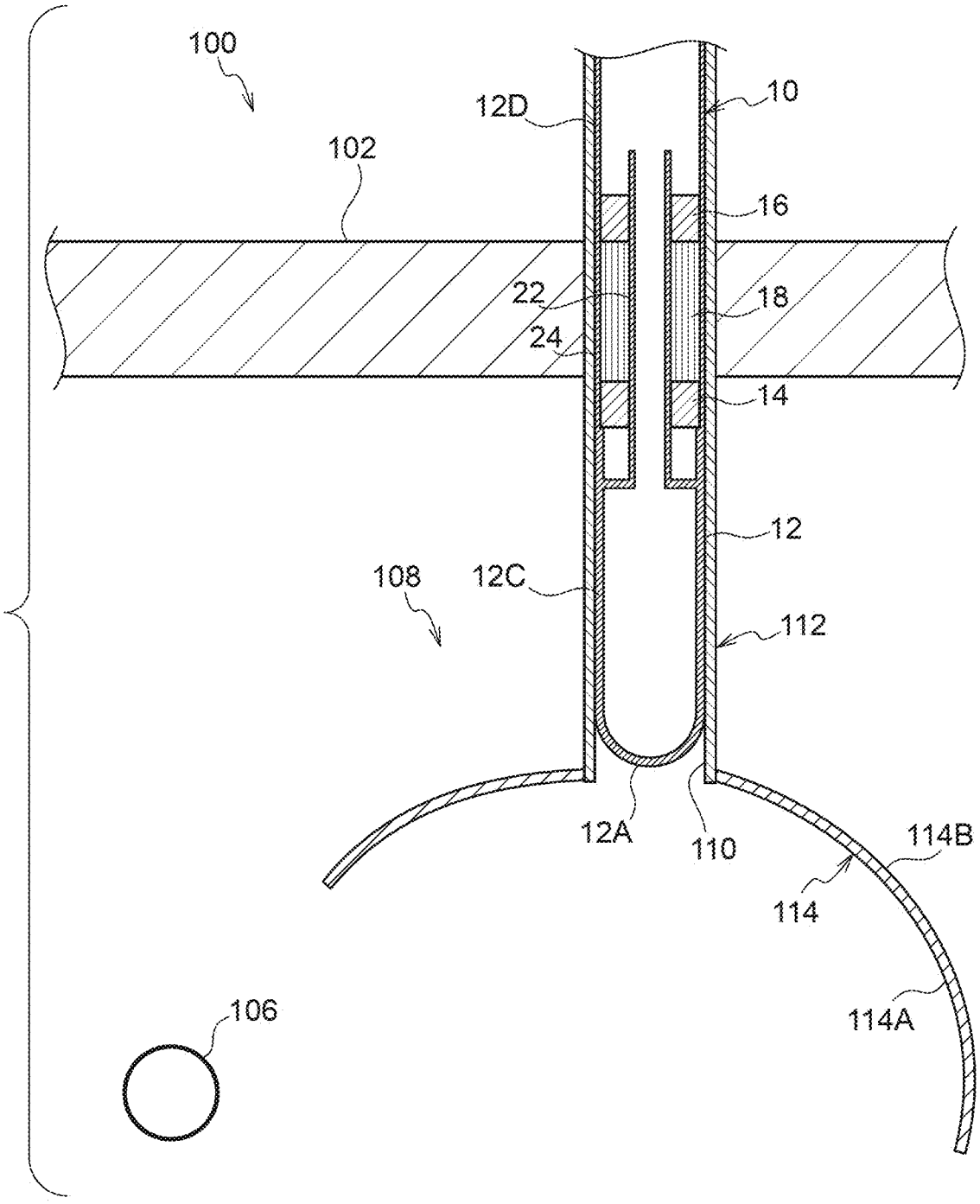
FIG. 15 is an enlarged sectional view showing the positional relationship between the reflector unit, the heat transfer device, and a heater when the furnace pertaining to the third embodiment is being heated.

As shown in FIG. 14, the reflector units 108 each have a pipe portion 112, which is shaped like a hollow cylinder and in which is formed a hole portion 110 that runs through it in the axial direction, and a reflector 114, which is attached to the distal end of the pipe portion 112 and in which is formed a reflective surface 114A comprising a paraboloid (see FIG. 15).

As shown in FIG. 15, the reflector 114 is attached in a state in which it is inclined a predetermined angle with respect to the axial direction of the pipe portion 112. Furthermore, one end of the hole portion 110 of the pipe portion 112 opens to the reflector 114 (see FIG. 13).

The reflector unit 108 configured in this way is disposed in the furnace 100 in such a way that the pipe portion 112 runs through the top or bottom furnace wall 102 and the reflector 114 attached to one end of the pipe portion 112 is positioned inside the furnace. The other end of the pipe portion 112 is disposed outside the furnace wall 102 (hereinafter called "(the) outside (of) the furnace").

The reflector unit 108 is configured in such a way that by rotating the other end of the pipe portion 112, the reflector 114 can be rotated about the axis of the pipe portion 112. Furthermore, the reflector unit 108 is configured in such a way that by moving the pipe portion 112 forward and backward with respect to the furnace wall 102, the reflector 114 can be moved toward and away from the furnace wall 102.

Moreover, as shown in FIG. 15, the heat transfer device 10 is disposed in the hole portion 110 of the pipe portion 112 of the reflector unit 108. The first end portion 12A side of the heat transfer device 10 is inserted inside the furnace 100 (the furnace wall 102), and the second end portion 12B side is disposed projecting outside the furnace 100 (the furnace wall 102). Specifically, in the axial direction of the heat transfer device 10 (the tubular body 12), the portion from the first end portion 12A to the first heat exchanger 14 is inserted inside the furnace, and the portion from the second heat exchanger 16 to the second end portion 12B is disposed outside the furnace. Furthermore, the regenerator 18 of the heat transfer device 10 is disposed in the furnace wall 102 of the furnace 100. It will be noted that in FIG. 15 the thickness of the furnace wall 102 is depicted as being thin for convenience of description of the drawing.

Figure 16:
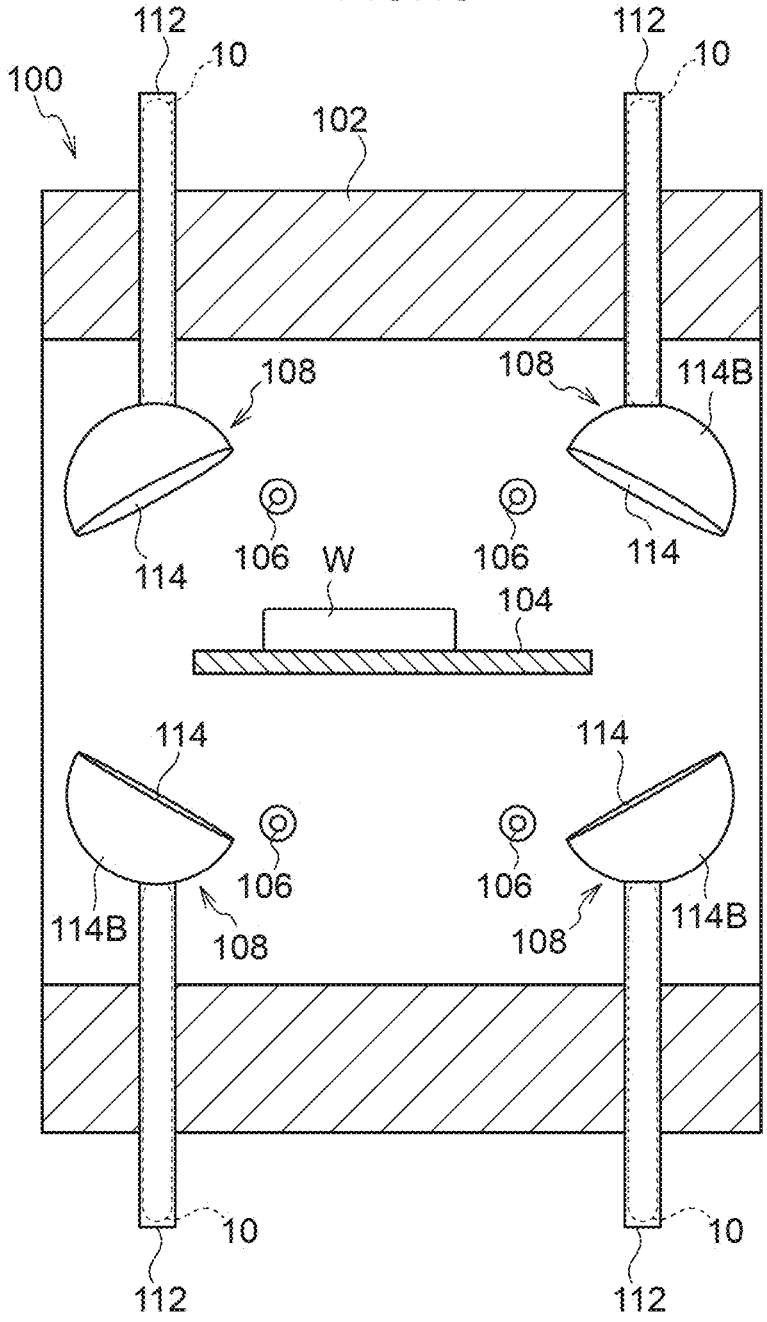
FIG. 16 is a sectional view showing the furnace pertaining to the third embodiment when it is being heated.

Furthermore, the heat transfer device 10 is secured to the furnace wall 102. Consequently, as shown in FIG. 15 and FIG. 16, by moving the reflector unit 108 (the pipe portion 112) forward inside the furnace, the heat transfer device 10 can be accommodated inside the hole portion 110. Furthermore, by moving the reflector unit 108 (the pipe portion 112) backward outside the furnace, the first end portion 12A side of the heat transfer device 10 can also be allowed to project from the hole portion 110 of the reflector unit 108 on the reflective surface 114A side of the reflector 114 and be exposed to the inside of the furnace.

Furthermore, as shown in FIG. 15, the portion of the tubular body 12 of the heat transfer device 10 in the range along the axial direction from the first end portion 12A to the first heat exchanger 14 is configured as a thick plate portion 12C whose plate thickness is thicker than that of the other portion. It will be noted that the other portion will be called a thin plate portion 12D.

As shown in FIG. 13, the reflector unit 108 and the heat transfer device 10 configured in this way are arranged two (a set) each a fixed distance apart from each other in two rows in the furnace wall 102 on the upper side of the furnace 100 and are also arranged two (a set) each a fixed distance apart from each other in two rows in the furnace wall 102 on the lower side of the furnace 100. That is, when the furnace 100 is viewed in plan, the reflector units 108 and the heat transfer devices 10 are disposed on the outer sides of the heaters 106.

(Operation)

The operation of the furnace 100 will be described. First, a case where the furnace 100 is heated will be described.

In this case, as shown in FIG. 13, FIG. 15, and FIG. 16, the pipe portions 112 of the reflector units 108 are moved forward inside the furnace to thereby move the reflectors 114 in the direction away from the furnace wall 102.

As a result, as shown in FIG. 15, the heat transfer devices 10 become entirely accommodated inside the hole portions 110 of the pipe portions 112. That is, the first end portion 12A sides of the heat transfer devices 10 are not exposed to the inside of the furnace (the reflective surface 114A sides of the reflectors 114). Furthermore, the end portions of the inner tubes 22 of the heat transfer devices 10 are closed off by the regulating valves 20 (see FIG. 3).

Moreover, as shown in FIG. 16, the pipe portions 112 of the reflector units 108 are rotated about their axes to thereby point the reflective surfaces 114A of the reflectors 114 toward the adjacent heaters 106 and the worktable 104 (the work W).

In this state, the work W that is the processing target is inserted onto the worktable 104 inside the furnace and the heaters 106 are energized, whereby the temperature inside the furnace is raised to the predetermined temperature.

At this time, as shown in FIG. 16, even when the heaters 106 are energized and the temperature difference between the inside of the furnace and the outside of the furnace increases, thermoacoustic self-excited oscillations are not produced in the regenerators 18 because the end portions of the inner tubes 22 of the heat transfer devices 10 are closed off by the regulating valves 20. That is, a situation where standing waves produced by thermoacoustic self-excited oscillations are generated in the conduits of the heat transfer devices 10 and the heat inside the furnace is rejected to the outside of the furnace is prevented.

Furthermore, because the heat transfer devices 10 are entirely accommodated inside the hole portions 110 of the pipe portions 112, the radiation inside the furnace is inhibited from being made incident on the heat transfer devices 10 directly or after being reflected by the reflective surfaces 114A of the reflectors 114.

That is, by inhibiting the radiation inside the furnace from being made incident on the heat transfer devices 10, the heat inside the furnace can be inhibited from being rejected by thermal conduction to the outside of the furnace via the tubular bodies 12 of the heat transfer devices 10 that extend from the inside of the furnace to the outside of the furnace.

In this way, because the heat inside the furnace can be inhibited from being rejected to the outside of the furnace via the heat transfer devices 10, the temperature inside the furnace 100 can be efficiently raised to the predetermined temperature.

Moreover, as shown in FIG. 15 and FIG. 16, the reflective surfaces 114A of the reflectors 114 are pointed toward the adjacent heaters 106 and the worktable 104. Because of this, the radiation from the heaters 106 becomes reflected by the reflective surfaces 114A of the reflectors 114 and made incident on the work W placed on the worktable 104. As a result, the work W placed on the worktable 104 becomes efficiently heated.

Next, a case where the furnace 100 is cooled will be described.

First, when the heating of the work W is finished after the temperature inside the furnace has been regulated to the predetermined temperature, the heaters 106 are deenergized. Next, the regulating valves 20 of the heat transfer devices 10 are moved backward to thereby open the end portions of the inner tubes 22.

Figure 17:
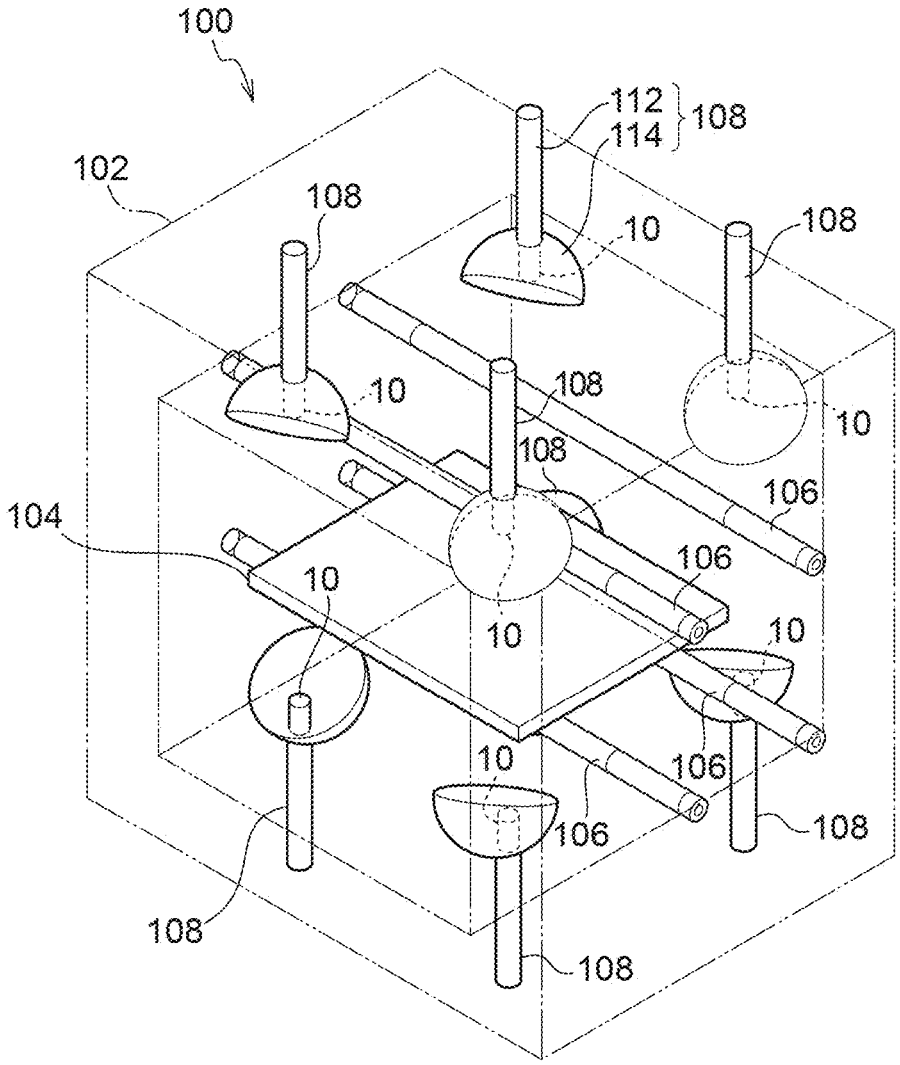
FIG. 17 is a general perspective view showing the furnace pertaining to the third embodiment when it is being cooled.
Figure 18:
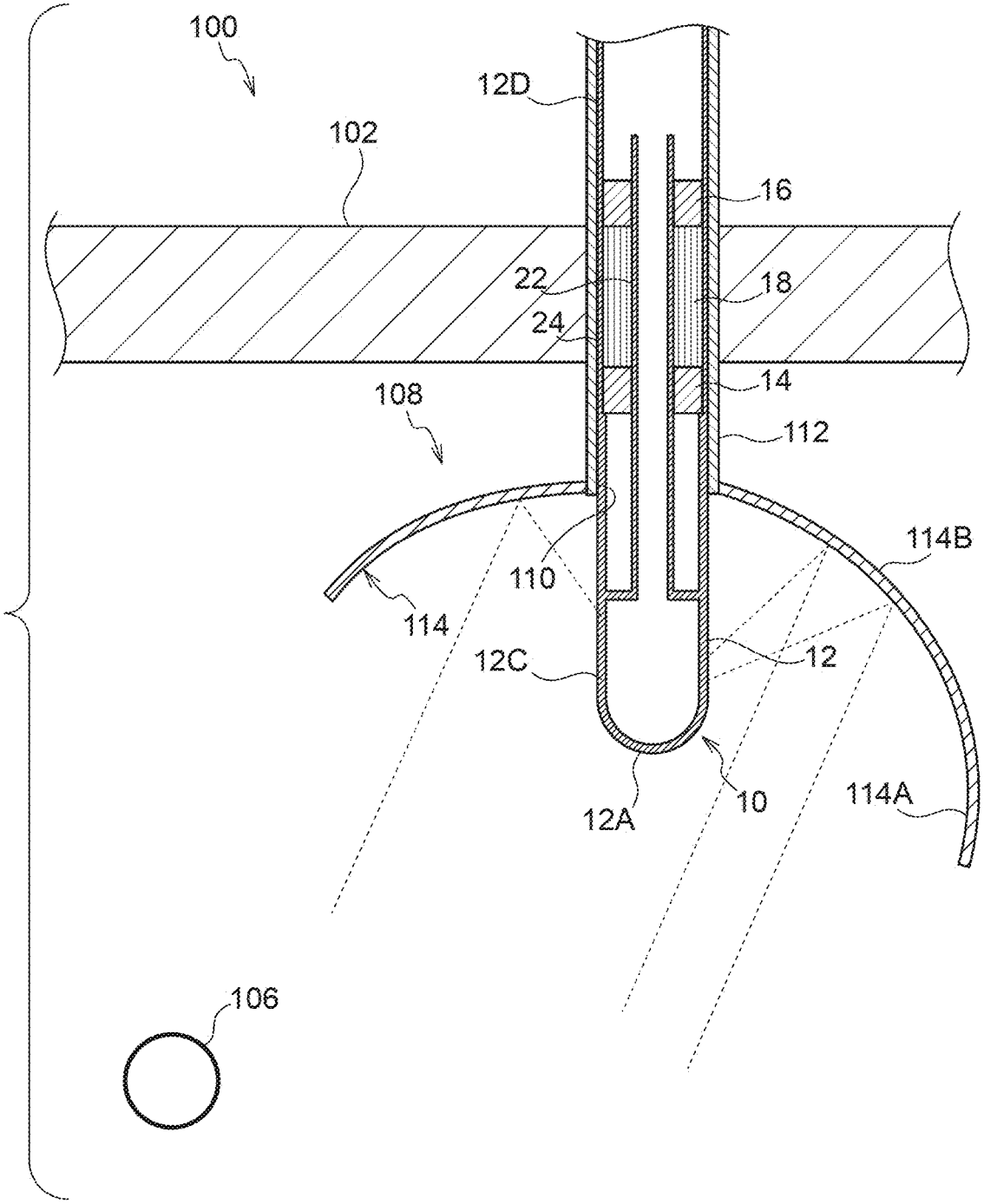
FIG. 18 is an enlarged sectional view showing the positional relationship between the reflector unit, the heat transfer device, and the heater when the furnace pertaining to the third embodiment is being cooled.
Figure 19:
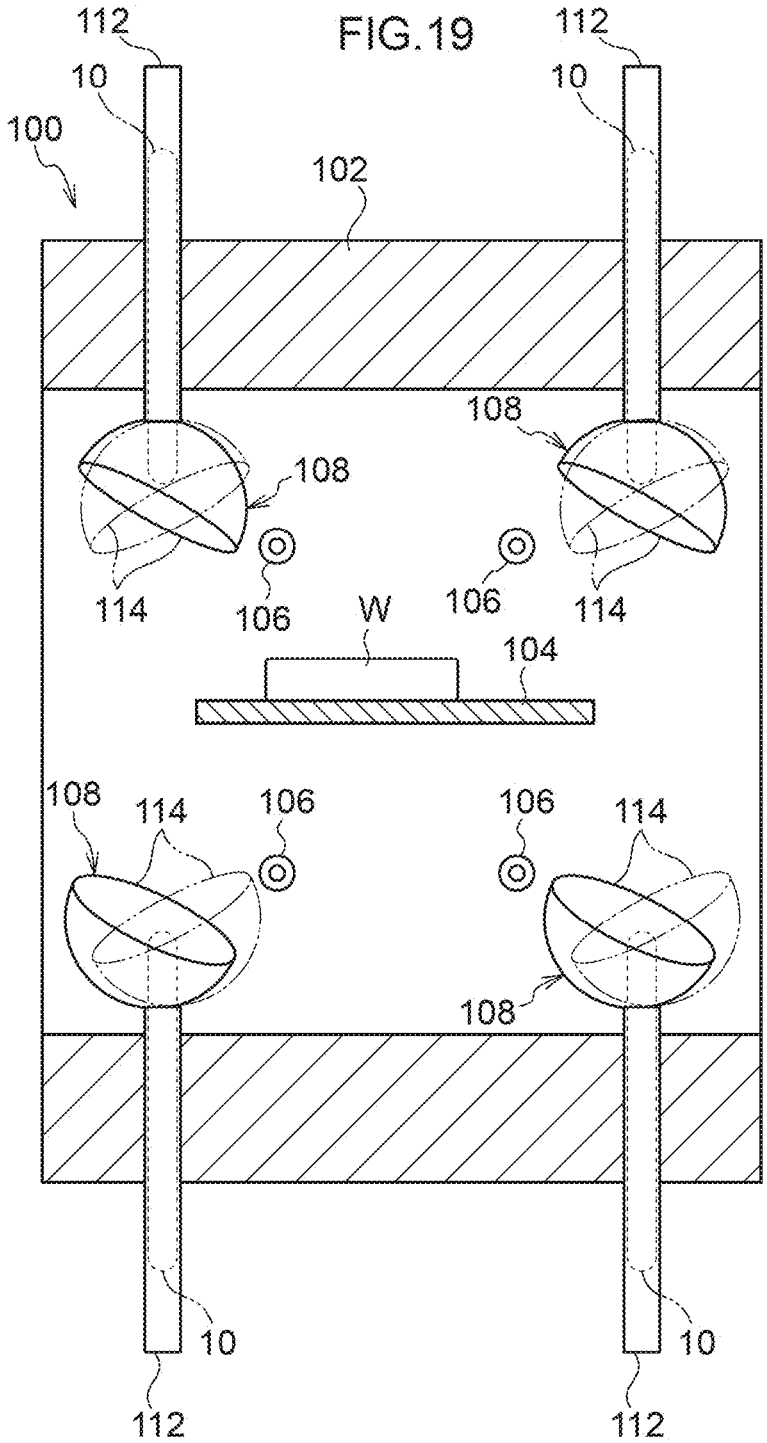
FIG. 19 is a sectional view showing the furnace pertaining to the third embodiment when it is being cooled.

Next, as shown in FIG. 17 to FIG. 19, the pipe portions 112 of the reflector units 108 are moved backward outside the furnace to thereby move the reflectors 114 toward the furnace wall 102. As a result, as shown in FIG. 18, the first end portion 12A sides (the sides inside the furnace) of the heat transfer devices 10 secured to the furnace wall 102 become exposed from the hole portions 110 of the pipe portions 112 to the inside of the furnace (the reflective surface 114A sides of the reflectors 114). That is, the first end portion 12A sides of the heat transfer devices 10 become positioned in the positions of the focuses of the reflectors 114 (the reflective surfaces 114A).

Moreover, as shown in FIG. 19, the pipe portions 112 of the reflector units 108 are rotated to thereby point the reflective surfaces 114A of the reflectors 114 (see FIG. 18) toward the work W and the furnace wall 102. As a result, as shown in FIG. 18, the radiation (infrared) (see the dashed lines in FIG. 18) from the furnace wall 102 and the work W that have reached a high temperature is reflected by the reflective surfaces 114A of the reflectors 114 and made incident (focused) on the first end portion 12A sides of the heat transfer devices 10 that project inside the reflectors 114 from the hole portions 110. As a result, the tubular bodies 12 in the neighborhoods of the incident positions of the heat transfer devices 10 become heated. The sections of the metal tubular bodies 12 from the first end portion 12A sides to the first heat exchangers 14 are configured as the thick plate portions 12C whose plate thickness is locally thick compared to the other portions (the thin plate portions 12D), so the heat can be efficiently conducted from the positions where the radiation is made incident to the positions where the first heat exchangers 14 are disposed.

In this way, when the first heat exchangers 14 become heated as a result of the radiation inside the furnace being made incident on the first end portion 12A sides of the heat transfer devices 10, the temperature ratio between both end portions (the first heat exchanger 14 side and the second heat exchanger 16 side) of the regenerators 18 exceeds the threshold. Because of this, thermoacoustic self-excited oscillations are produced in the regenerators 18 and standing waves are generated in the conduits in the heat transfer devices 10 in which the end portions of the inner tubes 22 have been opened by the regulating valves 20. Here, the regenerators 18 are in the conduits in positions that are 25% of the conduit length from the closed-off surfaces 26, so the heat efficiently moves from the first heat exchangers 14 inside the furnace to the second heat exchangers 16 outside the furnace.

At this time, as shown in FIG. 19, the reflector units 108 have their reflectors 114 rotated about the axes of the pipe portions 112. Because of this, radiation from a wide range including the work W and the furnace wall 102 can be reflected and made incident on the heat transfer devices 10, and the inside of the furnace can be evenly cooled.

In this way, in the furnace 100, the standing waves produced by the thermoacoustic self-excited oscillations in the heat transfer devices 10 are used to reject the heat inside the furnace to the outside of the furnace, so it becomes unnecessary to drive a pump or an actuator to reject the heat, the device configuration becomes simple, and the heat can be rejected efficiently.

Furthermore, when cooling the furnace, the radiation inside the furnace (from the furnace wall 102 and the work W) is reflected by the reflectors 114 and is concentrated and made incident on the first end portion 12A sides of the heat transfer devices 10 positioned in the positions of the focuses of the reflectors 114, so the heat transfer devices 10 can be efficiently heated. That is, the heat inside the furnace can be efficiently moved to the heat transfer devices 10.

Moreover, in the heat transfer devices 10, the portions of the tubular bodies 12 from the positions where the radiation is made incident on the first end portion 12A sides to the first heat exchangers 14 are configured as the thick plate portions 12C whose plate thickness is locally large compared to the other portions (the thin plate portions 12D), so the heat can be efficiently conducted from the positions where the radiation is made incident on the tubular bodies 12 to the first heat exchangers 14.

As a result, in the furnace 100, the heat inside the furnace can be rejected to the outside of the furnace even more efficiently.

It will be noted that although in the present embodiment the positions of the focuses resulting from the reflectors 114 were positions on the first end portion 12A sides of the first heat exchangers 14 of the heat transfer devices 10, if the positions of the focuses of the reflectors 114 are changed to the positions of the first heat exchangers 14 of the heat transfer devices 10, there is no longer the need to conduct the heat along the axial direction of the tubular bodies 12, the thick plate portions 12C become unnecessary, and the heat can be rejected to the outside of the furnace even more efficiently via the heat transfer devices 10.

Figure 20:
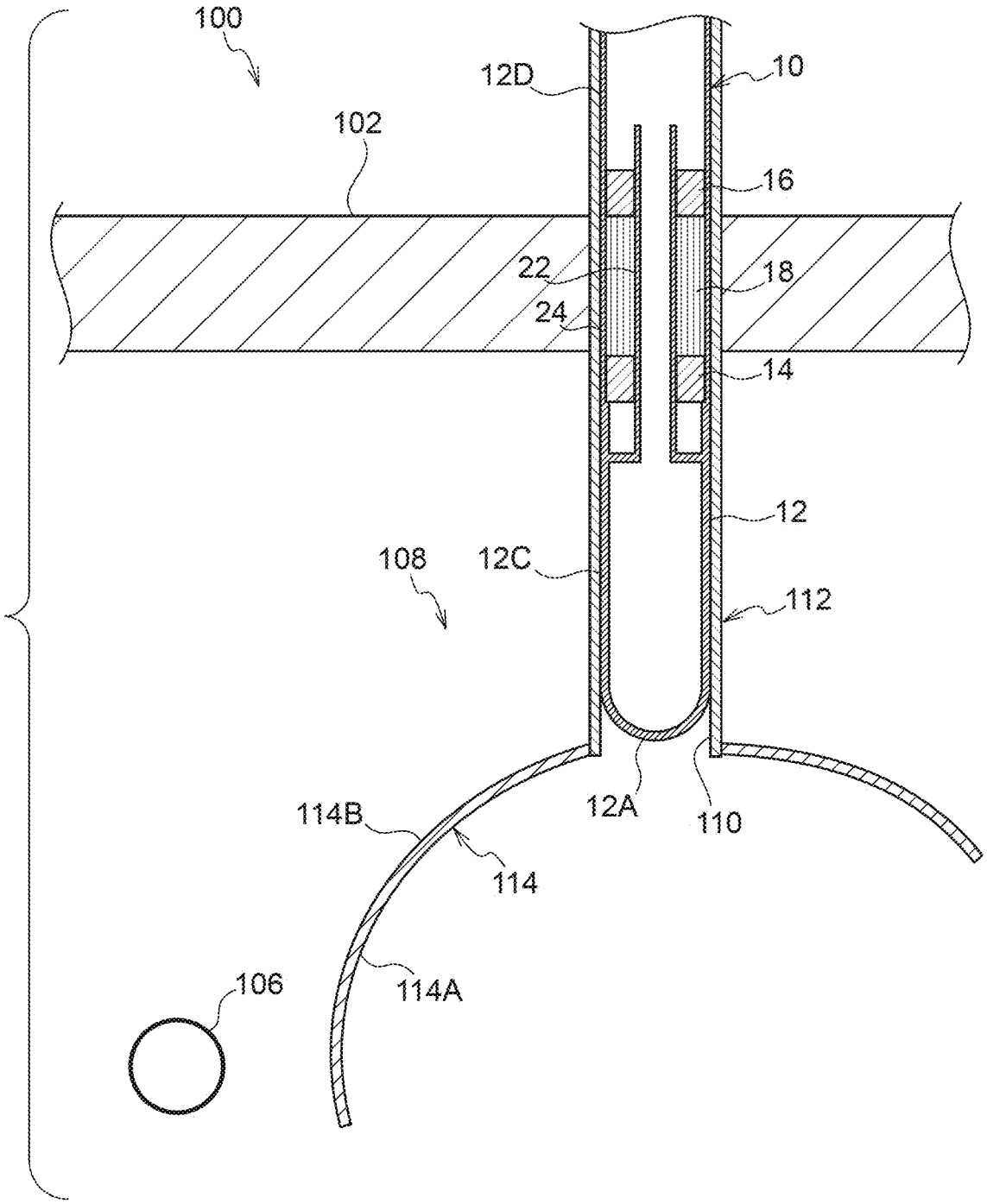
FIG. 20 is an enlarged sectional view showing the positional relationship between the reflector unit, the heat transfer device, and the heater when the furnace pertaining to another example of the third embodiment is being heated.
Figure 21:
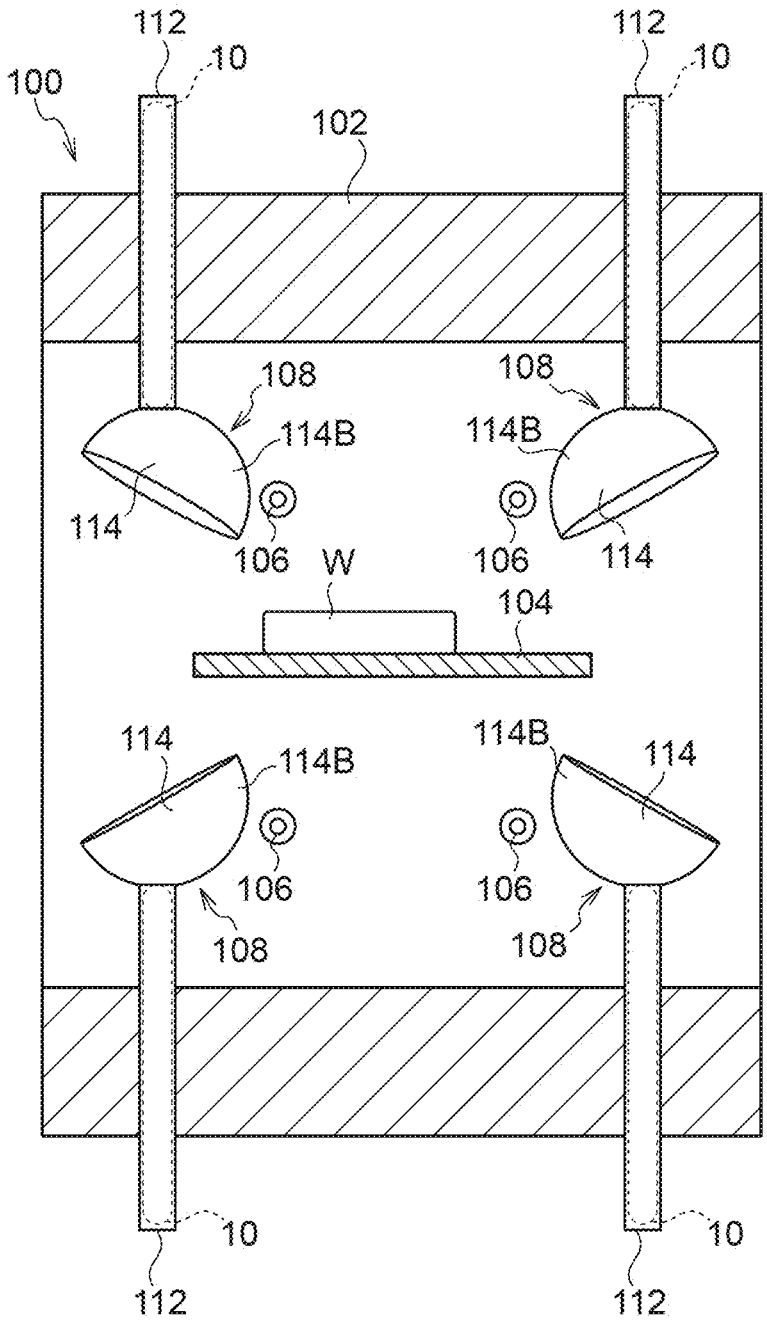
FIG. 21 is a sectional view showing the furnace pertaining to the other example of the third embodiment when it is being heated.

Furthermore, in the present embodiment, the reflective surfaces 114A of the reflectors 114 were pointed toward the heaters 106 and the worktable 104 when heating the furnace 100, but as shown in FIG. 20 and FIG. 21, the pipe portions 112 of the reflector units 108 can also be rotated about their axes to thereby point back surfaces 114B of the reflectors 114 toward the adjacent heaters 106.

In this case, as shown in FIG. 20 and FIG. 21, because the back surfaces 114B of the reflectors 114 are pointed toward the adjacent heaters 106, the radiation from the adjacent heaters 106 is inhibited from being made incident on the heat transfer devices 10. Furthermore, because the heat transfer devices 10 are entirely accommodated inside the hole portions 110 of the pipe portions 112, the radiation inside the furnace is inhibited from being made incident on the heat transfer devices 10 even if it is reflected by the reflective surfaces 114A of the reflectors 114. As a result, the radiation made incident on the heat transfer devices 10 is limited even more, and the heat inside the furnace is inhibited even more from moving to the outside of the furnace by thermal conduction via the tubular bodies 12 of the heat transfer devices 10.

By operating the reflector units 108 in this way also, the furnace 100 can be efficiently heated.

Fourth Embodiment (Device Configuration)

As a fourth embodiment of the disclosure, an industrial furnace to which the heat transfer device 10 pertaining to the first embodiment has been applied will be described with reference to FIG. 22 and FIG. 23. Regarding constituent elements that are the same as those of the third embodiment, the same reference signs are assigned thereto and description thereof will be omitted. It will be noted that the only thing different from the third embodiment is the shape of the reflector, so only that will be described.

Figure 22:
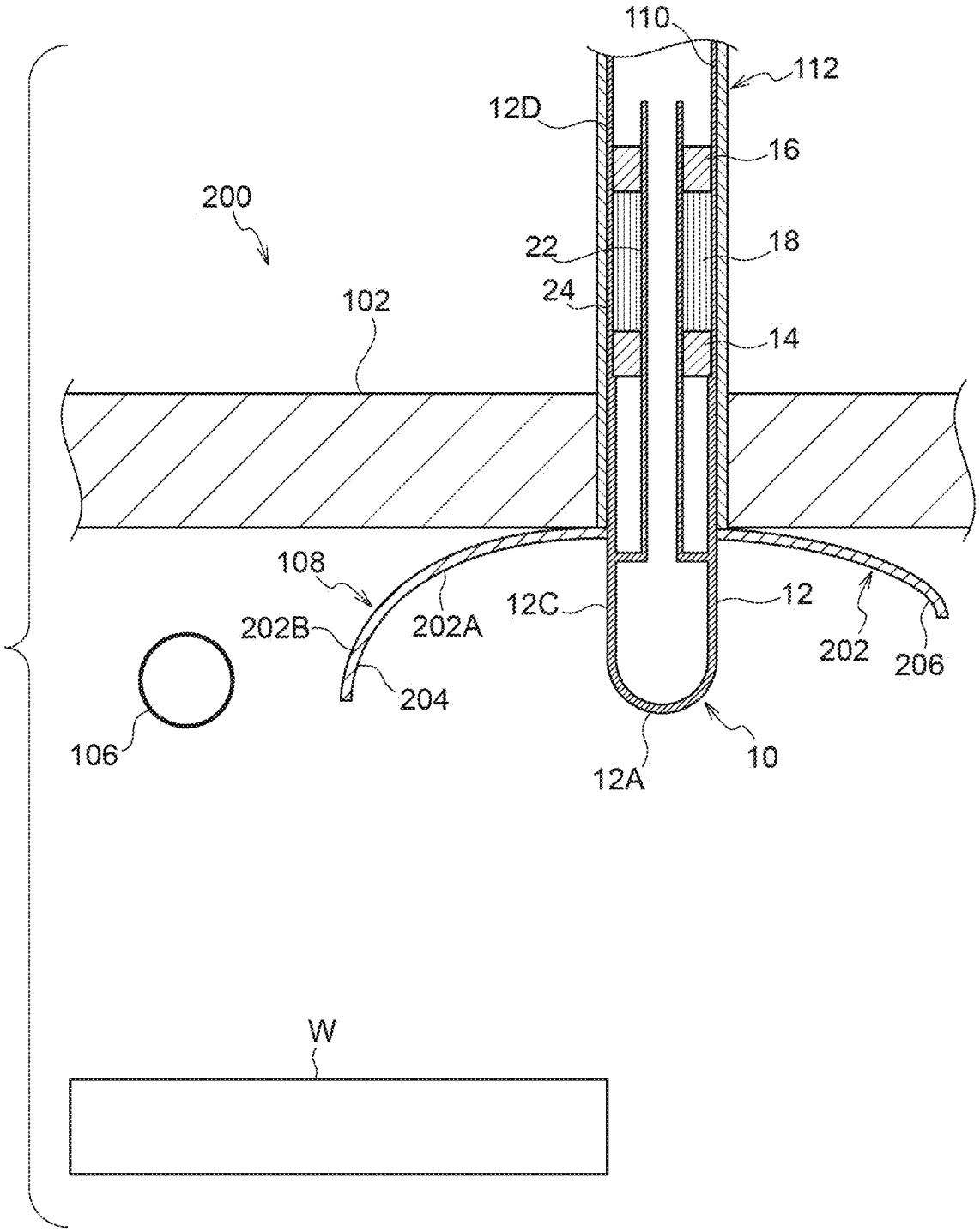
FIG. 22 is an enlarged sectional view showing the positional relationship between the reflector unit, the heat transfer device, and the heater when a furnace pertaining to a fourth embodiment is being heated.
Figure 23:
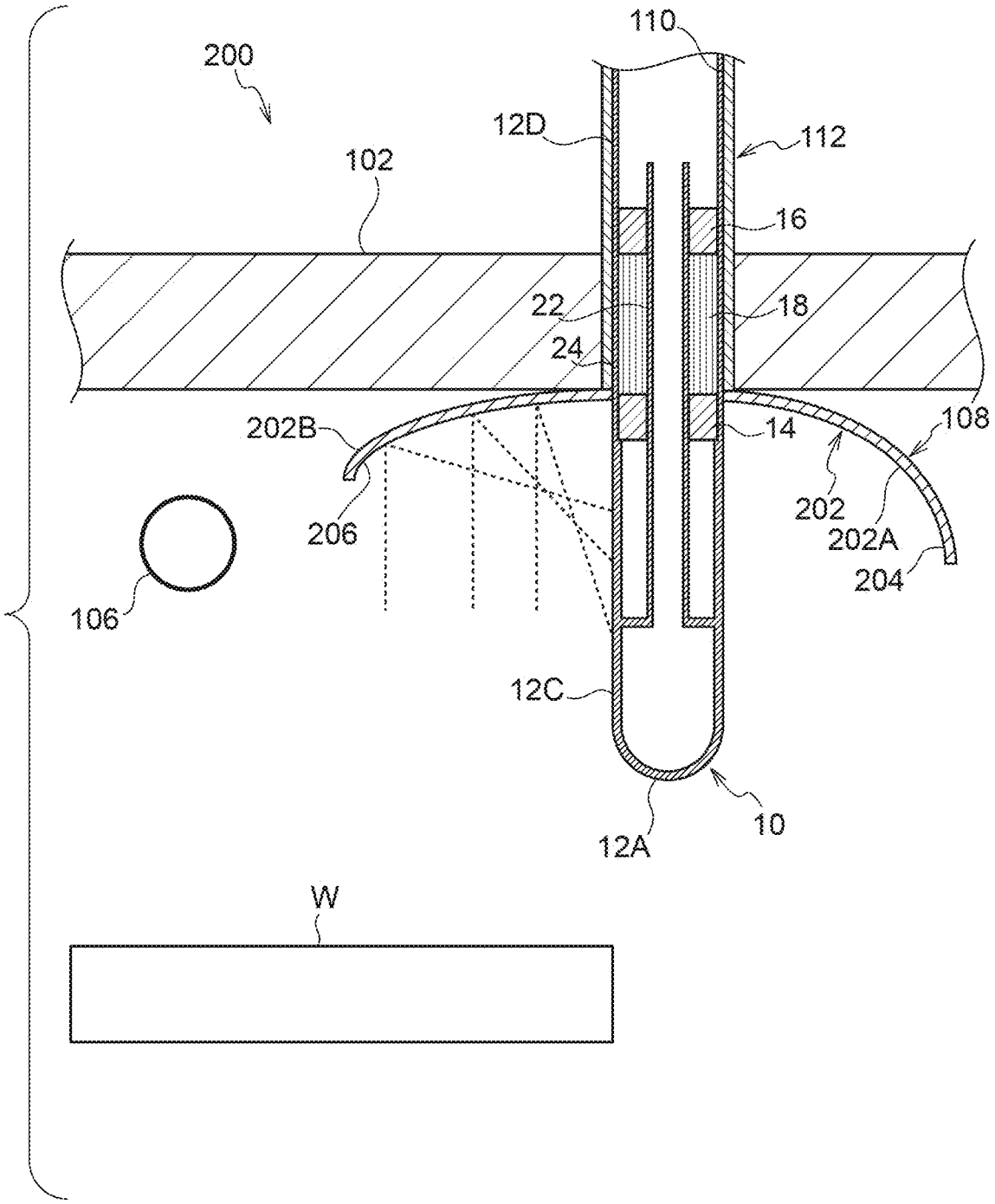
FIG. 23 is an enlarged sectional view showing the positional relationship between the reflector unit, the heat transfer device, and the heater when the furnace pertaining to the fourth embodiment is being cooled.

As shown in FIG. 22 and FIG. 23, a reflector 202 used in the reflector unit 108 of a furnace 200 has a bilaterally asymmetrical radial-direction cross section, and is a defocused type of reflector. The side of the reflector 202 that stands up more in the axial direction in the radial-direction cross section is a high-curvature portion 204, and the opposite side is a low-curvature portion 206.

It will be noted that the reflector 202 of the reflector unit 108 is rotated about its axis by rotating the pipe portion 112, but it does not move forward and backward in the axial direction. The heat transfer device 10 is configured to be movable forward and backward along its axial direction inside the hole portion 110 of the pipe portion 112.

Furthermore, the heat transfer device 10 of the present embodiment does not have a regulating valve.

(Operation)

In the furnace 200 configured in this way, as shown in FIG. 22, when heating the furnace, the heat transfer device 10 is moved backward outside the furnace. Specifically, the portion of the heat transfer device 10 up to the position of the first heat exchanger 14 is disposed outside the furnace, and only the first end portion 12A side is exposed to a reflective surface 202A side of the reflector 202.

Consequently, in the furnace 200, even when a temperature difference arises between the inside of the furnace and the outside of the furnace because of the heating by the heater 106, the temperature ratio between both end portions of the regenerator 18 does not exceed the threshold and thermoacoustic self-excited oscillations are not produced in the regenerator 18 because the first heat exchanger 14, the second heat exchanger 16, and the regenerator 18 of the heat transfer device 10 are all disposed outside the furnace. That is, in the heat transfer device 10, a situation where the heat inside the furnace is rejected to the outside of the furnace by the standing wave produced by thermoacoustic self-excited oscillations is prevented.

Furthermore, the high-curvature portion 204 of the reflector 202 is pointed toward the heater 106, so the radiation from the adjacent heater 106 is blocked by the high-curvature portion 204 and is inhibited from being made incident on the heat transfer device 10.

Consequently, when heating the furnace, a situation where the first end portion 12A side of the tubular body 12 of the heat transfer device 10 is heated by the radiation from the heater 106 and the heat inside the furnace is rejected to the outside of the furnace by thermal conduction through the tubular body 12 can be inhibited.

When cooling the furnace 200, first the heater 106 is deenergized. Next, the heat transfer device 10 is moved forward inside the furnace. Specifically, as shown in FIG. 23, the portion of the heat transfer device 10 from the first end portion 12A to the first heat exchanger 14 is disposed inside the furnace, the regenerator 18 is disposed in the furnace wall 102, and the portion of the heat transfer device 10 from the second heat exchanger 16 to the second end portion 12B is disposed outside the furnace.

Next, the reflector 202 is pointed toward the work W and the furnace wall 102, whereby the radiation emitted from the work W and the furnace wall 102 and the radiation reflected by the reflective surface 202A of the reflector 202 (see the dashed lines in FIG. 23) is made incident on the first end portion 12A side of the heat transfer device 10. The positions where the radiation is made incident on the tubular body 12 of the heat transfer device 10 are heated, and the heat is conducted via the thick plate portion 22C to the first heat exchanger 14. Because of this, the first heat exchanger 14 is efficiently heated. As a result, the temperature ratio between both end portions of the regenerator 18 exceeds the threshold, thereby producing thermoacoustic self-excited oscillations in the regenerator 18 and producing a standing wave in the conduit of the heat transfer device 10. Because of this, the heat inside the furnace can be efficiently rejected to the outside of the furnace. That is, the furnace 200 can be efficiently cooled.

In this way, in the furnace 200, the portion of the heat transfer device 10 up to the first heat exchanger 14 is disposed outside the furnace when heating the furnace, whereby thermoacoustic self-excited oscillations can be prevented from being produced in the regenerator 18 of the heat transfer device 10 by the temperature difference between the inside and the outside of the furnace 200 so that the heat inside the furnace can be inhibited from moving to the outside of the furnace. That is, even in a structure where the heat transfer device 10 does not have the regulating valve 20, heat rejection by the heat transfer device 10 can be inhibited when heating the furnace 200.

Furthermore, in the furnace 200, a back surface 202B of the high-curvature portion 204 of the reflector 202 of the reflector unit 108 is pointed toward the adjacent heater 106 when heating the furnace 200, whereby the radiation from the heater 106 can be inhibited from being made incident on the heat transfer device 10 so that heat rejection (heat movement) caused by thermal conduction through the heat transfer device 10 can be inhibited.

When cooling the furnace 200, the heat transfer device 10 is moved forward inside the furnace to thereby dispose the first heat exchanger 14 inside the furnace and dispose the second heat exchanger 16 outside the furnace, whereby thermoacoustic self-excited oscillations can be produced in the regenerator 18 of the heat transfer device 10 based on the temperature ratio between the inside and the outside of the furnace 200 and the standing wave can be generated in the conduit of the heat transfer device 10, so the heat inside the furnace can be efficiently rejected to the outside of the furnace.

Furthermore, even though the defocused type of reflector 202 is used in the reflector unit 108 of the furnace 200, by making incident on the heat transfer device 10 the radiation reflected even by the defocused type, the heat can be efficiently moved from the inside of the furnace to the heat transfer device 10.

It will be noted that although in the present embodiment the radiation from the heater 106 is inhibited from being made incident on the heat transfer device 10 by pointing the back surface 202B of the high-curvature portion 204 of the reflector 202 toward the adjacent heater 106 when heating the furnace 200, as in the third embodiment the reflective surface 202A of the reflector 202 may also be pointed toward the heater 106 and the worktable 104 (the work W) so that the radiation from the heater 106 is reflected by the reflective surface 202A of the reflector 202 and made incident on the work W. In this case, the efficiency with which the work W is heated when heating the furnace 200 is improved.

Figure 24:
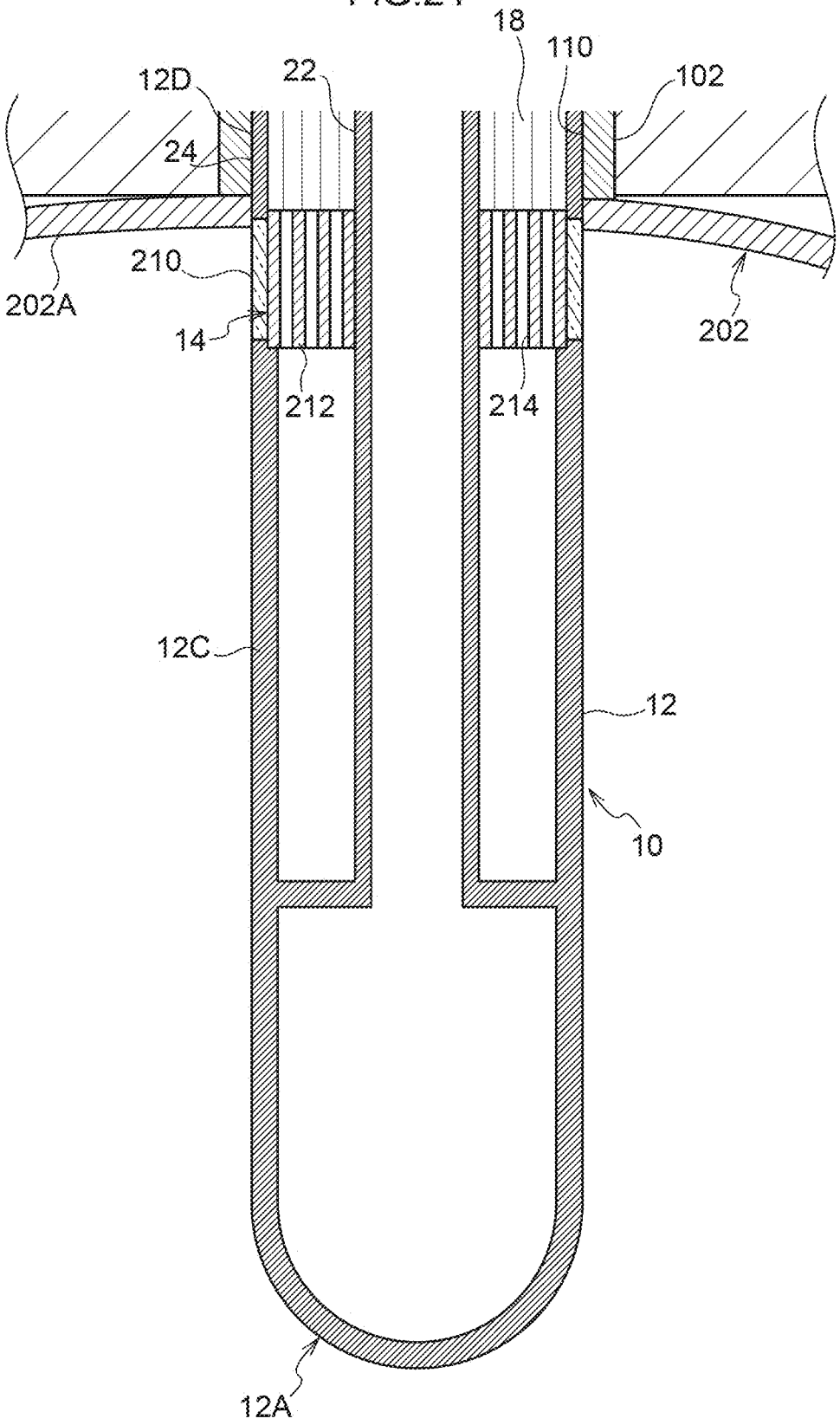
FIG. 24 is an enlarged sectional view of relevant portions showing the positional relationship between the reflector unit and the heat transfer device when the furnace pertaining to another example of the fourth embodiment is being cooled.

Next, another example of the furnace 200 will be described. Only the heat transfer device 10 is different, so only that will be described. As shown in FIG. 24, a heat transfer device 10 is conceivable where a radiation transmitting portion 210 formed of a radiation-transmitting material such as glass, for example, is formed in only the portion of the tubular body 12 formed of metal that is positioned on the outer peripheral side of the first heat exchanger 14.

The first heat exchanger 14 is a donut-shaped ring 212 formed of metal and fitted between the inner tube 22 and the outer tube 24 of the heat transfer device 10, and numerous hole portions 214 that extend in the axial direction are formed inside.

By forming the heat transfer device 10 in this way, when cooling the furnace 200 the radiation inside the furnace or the radiation reflected by the reflector 202 is transmitted through the radiation-transmitting portion 210 and directly made incident on the first heat exchanger 14. In this way, the first heat exchanger 14 (the ring 212) is directly heated by the radiation, so the heat inside the furnace becomes moved even more efficiently to the first heat exchanger 14.

Fifth Embodiment

As a fifth embodiment of the disclosure, an industrial furnace to which the heat transfer device 10 pertaining to the first embodiment has been applied will be described with reference to FIG. 25 to FIG. 28. Regarding constituent elements that are the same as those of the third embodiment, the same reference signs are assigned thereto and description thereof will be omitted. It will be noted that what is different from the third embodiment is the shape of the reflectors and the arrangement of the heaters, so only those will be described.

(Device Configuration)

Figure 25:
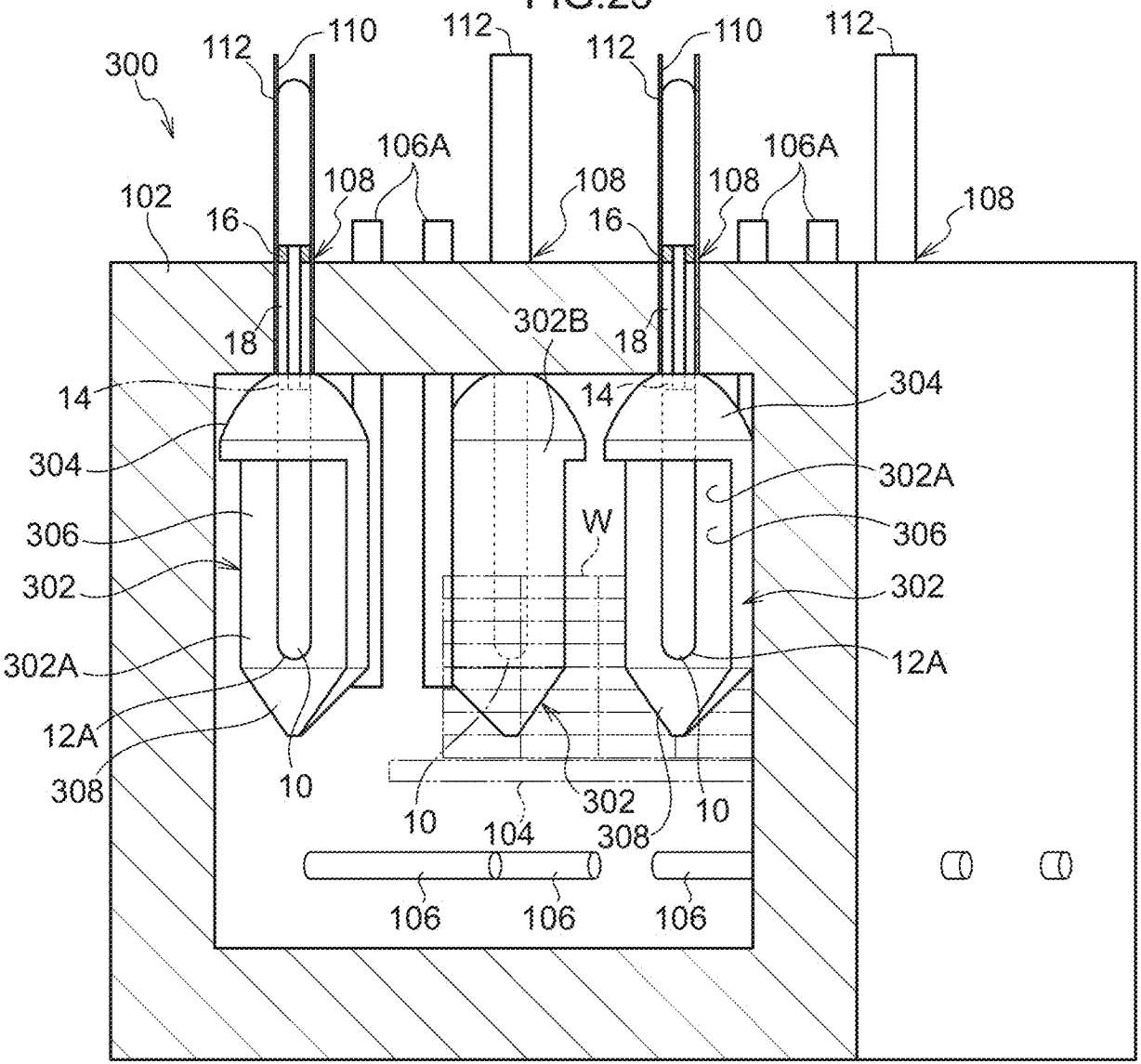
FIG. 25 is a general perspective view showing a furnace pertaining to a fifth embodiment when it is being heated.

As shown in FIG. 25, reflectors 302 configuring the reflector units 108 of a furnace 300 each have formed in them a parabolic portion 304 that is the same as the reflector 114 comprising a paraboloid of the third embodiment, a cross-sectionally semicircular trough portion 306 that is formed continuously downward from the lower end portion of the parabolic portion 304, and a cross-sectionally semicircular conical portion 308 that is formed continuously from the lower end portion of the trough portion 306.

Figure 26:
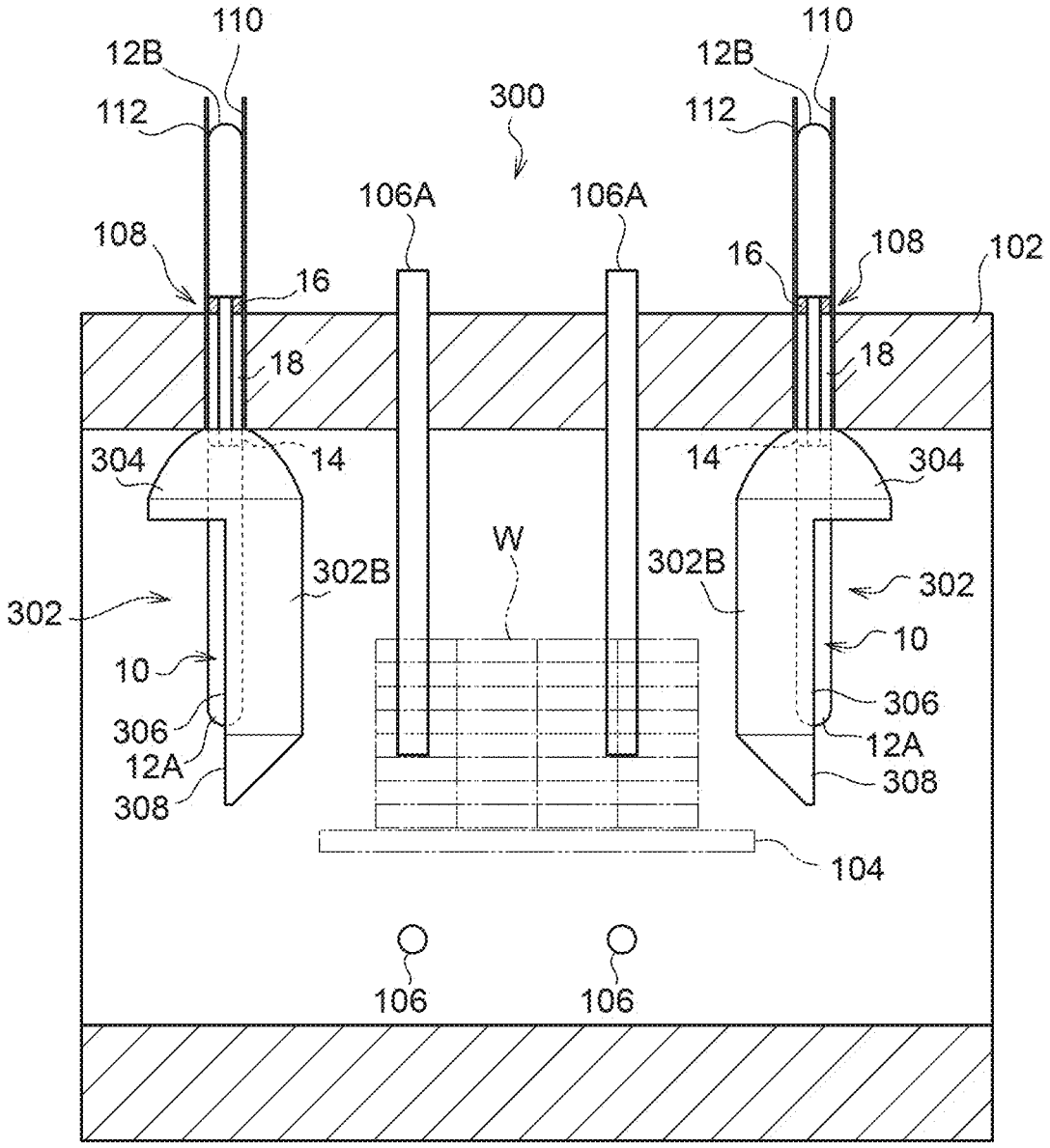
FIG. 26 is a sectional view showing the furnace pertaining to the fifth embodiment when it is being heated.

The heat transfer devices 10 are accommodated in the hole portions 110 of the pipe portions 112 of the reflector units 108. As shown in FIG. 26, each heat transfer device 10 is secured to the furnace wall 102 as in the third embodiment, with the portion from the first end portion 12A to the first heat exchanger 14 being disposed inside the furnace, the regenerator 18 being disposed in the furnace wall 102, and the portion from the second heat exchanger 16 to the second end portion 12B being disposed outside the furnace.

The pipe portions 112 of the reflector units 108 are configured to be rotatable about their axes, and the reflectors 302 are configured to be rotatable integrally with the pipe portions 112. However, the reflector units 108 do not move forward and backward with respect to the furnace wall 102.

Furthermore, in the furnace 300, two heaters 106 on one side that extend in the horizontal direction from the furnace wall 102 on the sides are arranged opposing each other under the worktable 104, and a total of four heaters and reflector units on one side comprising two heaters 106A and two reflector units 108 (heat transfer devices 10) that extend downward from the furnace wall 102 on the top are arranged in two rows parallel to each other in plan view.

(Operation)

The operation of the furnace 300 configured in this way will be described. First, the operation when heating the furnace 300 will be described.

When heating the furnace 300, the end portions of the inner tubes 22 are closed off by the regulating valves 20 of the heat transfer devices 10 (see FIG. 3). Next, the pipe portions 112 are rotated about their axes to thereby point back surfaces 302B of the trough portions 306 and the conical portions 308 of the reflectors 302 toward the adjacent heaters 106A.

In this state, the work W is placed on the worktable 104 and accommodated inside the furnace, and the heaters 106, 106A are energized.

At this time, even when the heaters 106, 106A are energized in the furnace 300 and the temperature difference between the inside of the furnace and the outside of the furnace increases, thermoacoustic self-excited oscillations are not produced in the regenerators 18 of the heat transfer devices 10 because the end portions of the inner tubes 22 are closed off by the regulating valves 20. That is, a situation where standing waves resulting from thermoacoustic self-excited oscillations are produced in the conduits of the heat transfer devices 10 so that the heat inside the furnace is rejected to the outside of the furnace by the standing waves is prevented.

Furthermore, the heaters 106A are arranged parallel to the adjacent heat transfer devices 10, but when heating the furnace 300, the heat transfer devices 10 are blocked by the back surfaces 302B of the trough portions 306 and the conical portions 308 of the reflectors 302, so the radiation from the heaters 106A is inhibited from being made incident on the heat transfer devices 10 directly or after being reflected by the reflectors 302.

Consequently, the heat inside the furnace can be inhibited from being rejected to the outside of the furnace by thermal conduction via the tubular bodies 12 of the heat transfer devices 10. That is, the efficiency with which the furnace 300 is heated can be improved.

Next, the operation when cooling the furnace 300 will be described.

Figure 27:
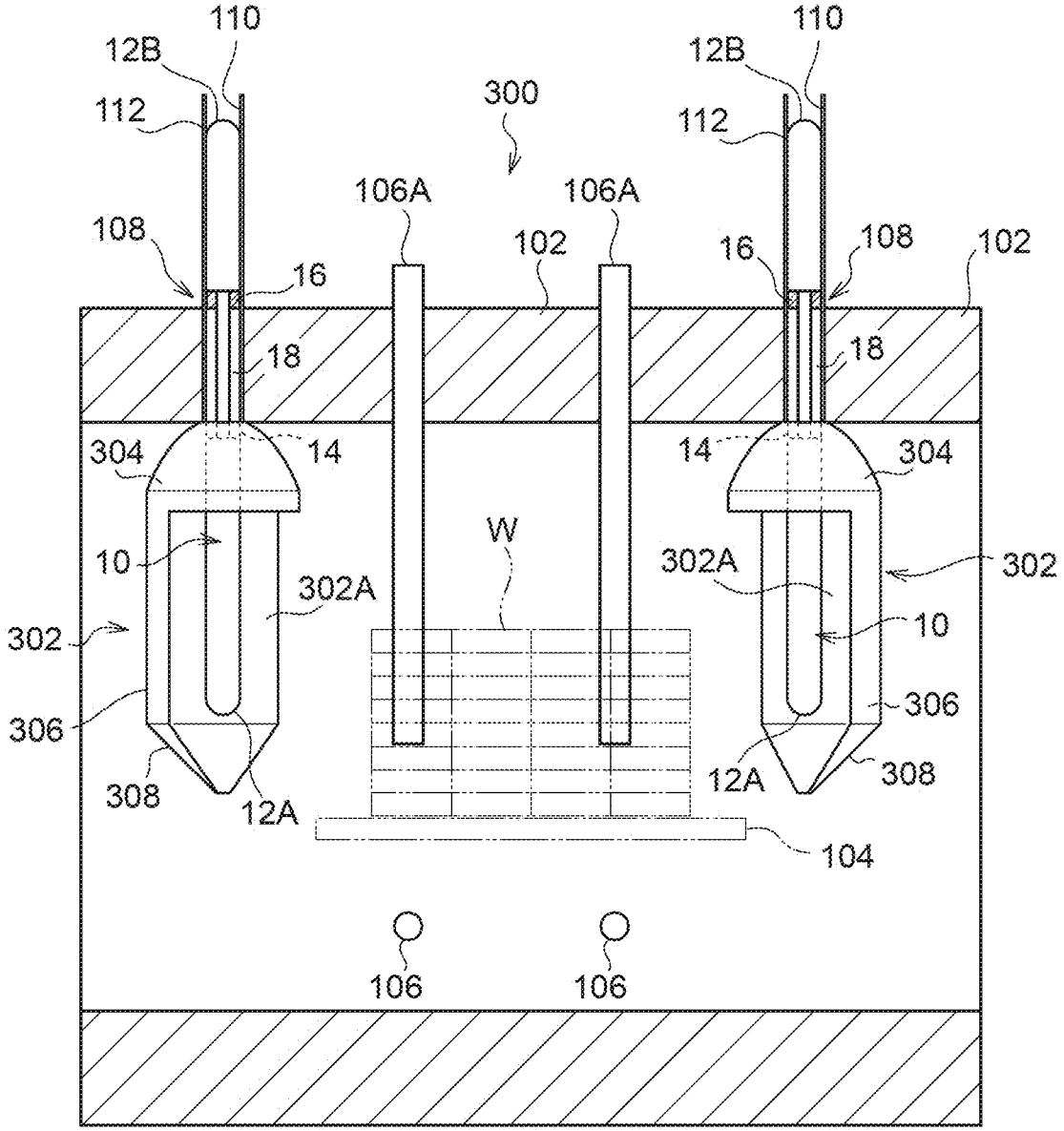
FIG. 27 is a sectional view showing the furnace pertaining to the fifth embodiment when it is being cooled.

First, the heaters 106, 106A of the furnace 300 are deenergized. Next, as shown in FIG. 27, the pipe portions 112 of the reflector units 108 are rotated to thereby point the reflective surfaces 302A of the reflectors 302 toward the work W and the furnace wall 102.

Furthermore, the regulating valves 20 of the heat transfer devices 10 are moved to thereby open the end portions of the inner tubes 22.

In this state, the radiation from the work W and the furnace wall 102 is reflected by the trough portions 306 and the conical portions 308 of the reflectors 302, is made incident on the first end portion 12A sides of the first heat exchangers 14 of the heat transfer devices 10, and heats those portions. The portions of the tubular bodies 12 of the heat transfer devices 10 on the first end portion 12A sides of the first heat exchangers 14 are configured as the thick plate portions 12C (see FIG. 15), and it is easier for heat to be conducted through them than the thin plate portions 12D (see FIG. 15). Consequently, the heat on the first end portion 12A sides of the first heat exchangers 14 of the heat transfer devices 10 can be efficiently moved to the first heat exchangers 14.

Furthermore, in the parabolic portions 304 of the reflectors 302, the radiation made incident from the work W and the furnace wall 102 is directly made incident thereon, the radiation reflected by the trough portions 306 and the conical portions 308 is made incident thereon, and is reflected to the positions where the first heat exchangers 14 of the heat transfer devices 10 are disposed. That is, the radiation from the work W and the furnace wall 102 is more concentrated and made incident on the first heat exchanger portions of the heat transfer devices 10, and the first heat exchangers 14 are efficiently heated.

That is, the heat inside the furnace efficiently moves via the radiation to the first heat exchangers 14.

Furthermore, when the temperature ratio between both end portions (the end portions on the first heat exchanger 14 sides and the end portions on the second heat exchanger 16 sides) of the regenerators 18 exceeds the threshold, this produces thermoacoustic self-excited oscillations in the regenerators 18 of the heat transfer devices 10 and produces standing waves in the conduits of the heat transfer devices 10, and the heat inside the furnace is efficiently rejected to the outside of the furnace by the standing waves.

In this way, in the furnace 300, the back surfaces 302B of the reflectors 302 are pointed toward the heaters 106A when heating the furnace, so the radiation from the heaters 106, 106A is inhibited from being made incident on the heat transfer devices 10, and heat movement to the outside of the furnace caused by thermal conduction through the heat transfer devices 10 is inhibited. That is, heating efficiency is improved.

Furthermore, in the furnace 300, by providing the heaters 106A that extend in the up and down direction, the work W that is placed on the worktable 104 and has a certain height in the up and down direction can be efficiently heated.

Moreover, in the furnace 300, the cross-sectionally semi-circular trough portions 306 and conical portions 308 are provided continuous with the lower sides of the parabolic portions 304 in the reflectors 302, so the radiation from the furnace wall 102 and the work W can be reflected and concentrated and made incident on the heat transfer devices 10. As a result, the heat inside the furnace can be moved even more efficiently to the heat transfer devices 10 utilizing the radiation.

The heat inside the furnace 300 is efficiently moved via the radiation to the first heat exchangers 14 of the heat transfer devices 10, so the heat moves via the thermoacoustic self-excited oscillations in the heat transfer devices 10 from the first heat exchangers 14 to the second heat exchangers 16. That is, the heat inside the furnace 300 can be efficiently rejected to the outside of the furnace.

Figure 28:
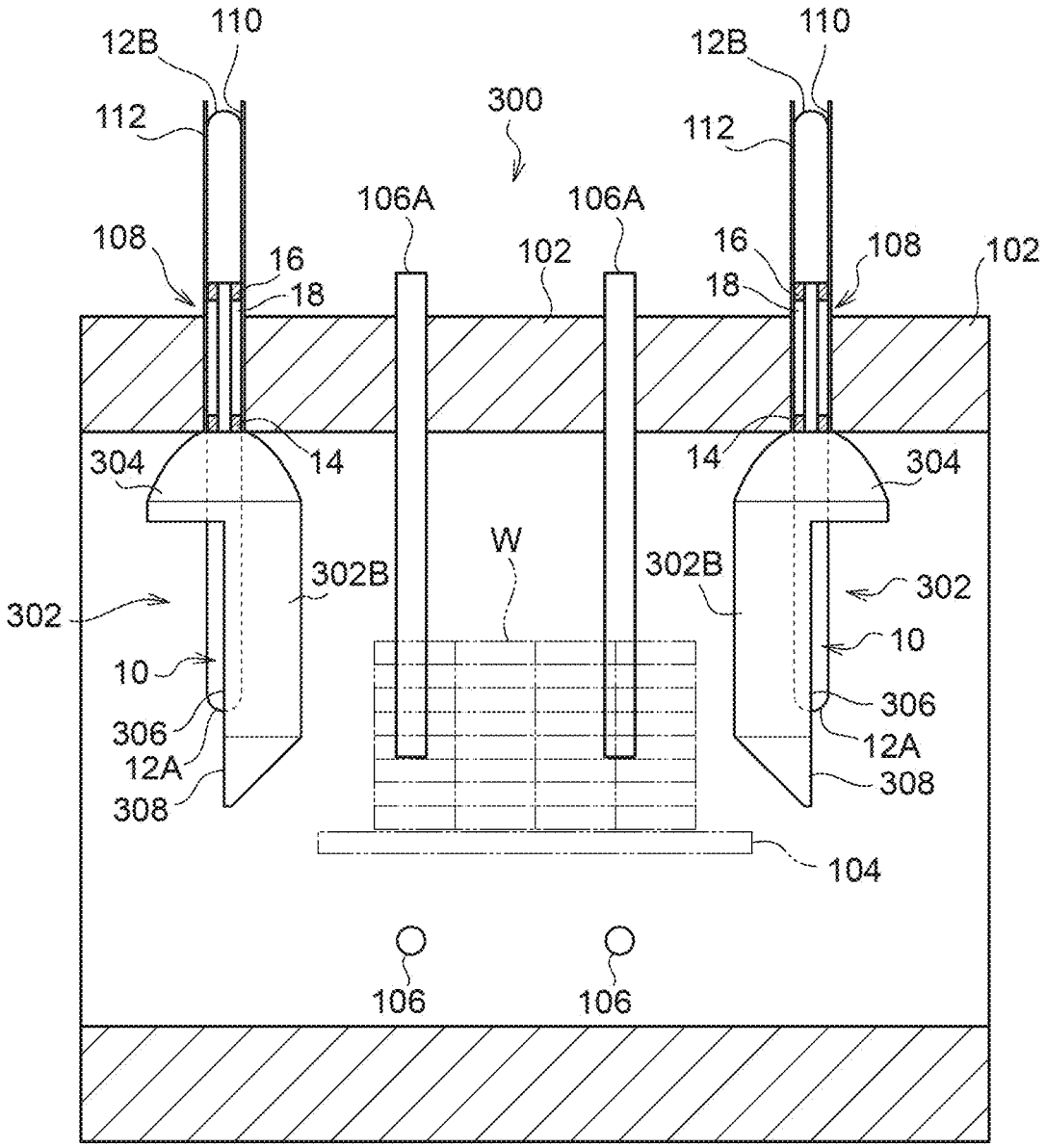
FIG. 28 is a sectional view showing the furnace pertaining to another example of the fifth embodiment when it is being heated.

It will be noted that, as shown in FIG. 28, by configuring the heat transfer devices 10 to be movable forward and backward with respect to the furnace wall 102 and positioning the heat transfer devices 10 up to the first heat exchangers 14 in the furnace wall 102 when heating the furnace 300, heating of the first heat exchangers 14 can be inhibited so that the thermoacoustic self-excited oscillations can be inhibited even more from being produced in the regenerators 18.

Furthermore, when heating the furnace 300, the reflective surfaces 302A of the reflectors 302 may also be pointed toward the adjacent heaters 106A and the work W, so that the radiation from the heaters 106A is reflected by the reflective surfaces 302A and made incident on the work W, thereby improving the efficiency with which the work W is heated.

Miscellaneous (Heat Transfer Device)

The heat transfer devices pertaining to the first and second embodiments have been described above, but the disclosure is not limited to this.

For example, in the heat transfer device 50 of the second embodiment, the regulating valve 20 was provided in the second end portion 12B side of the tubular body 12, but the heat transfer device 50 may also be given a configuration where the valve body is inserted from the radial direction outer side, at a position that is an equal distance as the axial direction distance from the center of the regenerator 18 in the axial direction to the first end portion 12A of the tubular body 12, into the second end portion 12B side of the tubular body 12 from the center of the regenerator 18 in the axial direction. In this case, the center of the regenerator 18 in the axial direction becomes positioned in the position of a node of the standing wave, so heat transfer can be stopped by inserting the valve body.

Furthermore, the center of the regenerator 18 in the axial direction was disposed in a position that is 25% of the conduit length L0 from the end portion on the high-temperature side (the closed-off surface 26 of the heat transfer device 10, the first end portion 12A of the heat transfer device 50) with respect to the conduit length L0, but the heat transfer amount is sufficiently large and the device is utilizable as a heat transfer device as long as the center of the regenerator 18 in the axial direction is disposed in the range of 12.5% to 25%.

It will be noted that although the heat transfer devices 10 and 50 of the first embodiment and the second embodiment had the regulating valve 20 as a regulating means, the heat transfer devices do not have to have the regulating valves. For example, in a case where it is not necessary to stop heat transfer, such as a case where heat is always extracted from waste heat, it is conceivable for the heat transfer device to not have the regulating valve.

Moreover, it is also conceivable to attach a power generator to the heat transfer device. For example, it is conceivable to attach a speaker-type power generator instead of the regulating valve 20 to the second end portion 12B of the heat transfer device 50 attached to the furnace 40, oscillate the speaker with a standing wave based on the thermoacoustic self-excited wave, and generate power. In this case, it is conceivable to stop heat transfer by inserting the regulating valve as described above inside the tubular body 12 from the radial direction outer side.

(Furnace)

Furthermore, the furnaces 100, 200, and 300 pertaining to the third to fifth embodiments have been described, but the disclosure is not limited to this.

For example, in the third embodiment, the reflector 114 was configured by a Newtonian paraboloid and the heat transfer device 10 was disposed in the position of the focus thereof, but it is also possible to employ a Cassegrain type, a Gregorian type, or a Martin type as types that similarly use a reflector to focus on the heat transfer device 10.

Moreover, in the third embodiment the reflector unit 108 was given a configuration that moves forward and backward with respect to the furnace 100, and in the fourth embodiment the heat transfer device 10 was given a configuration that moves forward and backward with respect to the furnace 200 and the furnace 300, but either may have a configuration that moves forward and backward, and both may have configurations that move.

In the third embodiment, the reflector 114 was described as being secured at an angle inclined with respect to the axial direction of the pipe portion 112, but the reflector 114 may also be given a configuration whose angle of inclination can be changed. In this case, by rotating the reflector 114 while changing its angle of inclination, the radiation from the furnace wall 102 and the work W can be made incident on the heat transfer device 10 in an even wider range. As a result, the furnace can be cooled even more efficiently.

Moreover, in the third and fifth embodiments, the regulating valve 20 was given a configuration that closes off the end portion of the inner tube 22 so as to not produce thermoacoustic self-excited oscillations in the regenerator 18 when heating the furnace, but as in the fourth embodiment, it is also possible to give the heat transfer device 10 a configuration that does not produce thermoacoustic self-excited oscillations by ensuring that the temperature ratio between both end portions (the end portion on the first heat exchanger 14 side and the end portion on the second heat exchanger 16 side) of the regenerator 18 does not exceed the threshold by moving the heat transfer device 10 backward to the outside of the furnace. In this case, the heat transfer device 10 does not have to have the regulating valve 20.

Furthermore, in the third to fifth embodiments, a case where the furnace is kept at a predetermined temperature (within a predetermined temperature range) was not described, but basically the furnace is heated by the heaters so as to supply a quantity of heat corresponding to the quantity of heat naturally rejected to the outside of the furnace. However, depending on the furnace, it is also conceivable for the heat to be rejected by the standing wave based on the thermoacoustic self-excited oscillations in the heat transfer device 10 whose heat transfer amount has been regulated by the regulating valve 20 while heating the furnace with the heater.

Moreover, in the third to fifth embodiments, the heat transfer device 10 was disposed inside the hole portion 110 of the pipe portion 112 of the reflector unit, but the heat transfer device 10 may also be disposed in a position different from the pipe portion 112 in the furnace. In this case, the radiation reflected by the reflective surface of the reflector is made incident on the heat transfer device 10 located in the different position.

In the third and fifth embodiments, cases of reflectors having a focus such as a paraboloid were described in consideration of concentration of the radiation made incident on the heat transfer device 10, but the reflective surface of the reflector does not have to have a focus.

Furthermore, it is also possible to apply, to a furnace that does not have a reflector, the point of forming the thick plate portion 12C in the heat transfer device 10, the point of forming the radiation transmitting portion 210, and the configuration that causes the heat transfer device 10 to move forward and backward with respect to the furnace wall.

Moreover, in the third to fifth embodiments, the heat transfer device 10 pertaining to the first embodiment was applied, but the heat transfer device 50 pertaining to the second embodiment may also be applied.

The disclosure of Japanese Patent Application No. 2017-103794 is incorporated by reference herein in its entirety.

All documents, patent applications, and technical standards described in this specification are incorporated by reference herein to the same extent as if each individual document, patent application, or technical standard were specifically and individually indicated to be incorporated by reference.

The invention claimed is:

1. A heat transfer device comprising:

a housing that is disposed straddling a high-temperature heat source and a low-temperature heat bath having lower temperature than the high-temperature heat source, that has a closed space within which a gas is sealed, and that has a conduit formed inside, both end portions of the conduit being closed off;

a regenerator that is disposed in the conduit, and at which are formed pores that communicate both end portions of the regenerator with each other, and which is insulated from the outside of the housing;

a first heat exchanger that is provided adjacent to an end portion of the regenerator on the high-temperature heat source side in the conduit, and that allows heat of the high-temperature heat source to move toward the regenerator; and a second heat exchanger that is provided adjacent to an end portion of the regenerator on the low-temperature heat bath side in the conduit, and that allows heat of the regenerator to move toward the low-temperature heat bath, wherein the center of the regenerator along an extending direction of the conduit is positioned on the conduit in a position that is from 12.5% to 25% of a conduit length from the end portion of the conduit on the high-temperature heat source side.

2. The heat transfer device according to claim 1, wherein: the conduit includes:

an inner tube, a part of which communicates the high-temperature heat source side with the low-temperature heat bath side in the housing and an outer tube that is formed on the outer side of the inner tube, and that communicates with the inner tube on the low-temperature heat bath side, an end portion on the high-temperature heat source side of the outer tube being closed off; and the first heat exchanger, the second heat exchanger, and the regenerator are disposed in the outer tube.

3. The heat transfer device according to claim 1, wherein the heat transfer device has a regulating unit that is disposed in the end portion of the housing on the low-temperature heat bath side so as to be movable forward and backward inside the housing and that transforms the waveform of a standing wave generated in the conduit by a thermoacoustic self-excited wave, by moving forward inside the housing.

4. A furnace comprising:

a furnace wall comprising insulation;

a heater that is disposed inside of the furnace circumscribed by the furnace wall, and that heats the inside of the furnace; and the heat transfer device according to claim 1, at which the regenerator is disposed at the furnace wall, the first heat exchanger is disposed inside the furnace, and the second heat exchanger is disposed outside the furnace, at least when cooling the furnace.

5. The furnace according to claim 4, further comprising a reflector that reflects radiation inside the furnace so as to be incident on the heat transfer device disposed inside the furnace.

6. The furnace according to claim 5, further comprising a shaft body that supports the reflector within the furnace, and that extends from the inside of the furnace to the outside of the furnace.

7. The furnace according to claim 6, wherein the reflector is configured to be rotatable integrally with the shaft body about the axial direction of the shaft body.

8. The furnace according to claim 6, wherein a hole portion that extends in the axial direction of the shaft body is formed at the shaft body, the heat transfer device is disposed inside the hole portion, and, at least when cooling the furnace, the end portion of the heat transfer device, on the side at which the first heat exchanger is disposed, is exposed from the inside of the hole portion to a reflective surface side of the reflector.

9. The furnace according to claim 8, wherein part of the end portion of the heat transfer device, on the side at which the first heat exchanger is disposed, is positioned in a focus of the reflective surface of the reflector at least when cooling the furnace.

10. The furnace according to claim 8, wherein the reflector is configured to be movable forward and backward with respect to the furnace wall along the axial direction integrally with the shaft body.

11. The furnace according to claim 4, wherein the heat transfer device is configured to be movable forward and backward with respect to the furnace wall along the axial direction of the heat transfer device.

12. The furnace according to claim 4, wherein the plate thickness of the housing, from the position at which the radiation inside the furnace is incident to the position at which the first heat exchanger is disposed, is locally thicker than the plate thickness of the other portion of the housing.

13. The furnace according to claim 4, wherein the portion of the housing on the outer peripheral side of the first heat exchanger is formed by a radiation-transmitting member.

* * * * *